US006626719B2

(12) United States Patent
Ono et al.

(10) Patent No.: US 6,626,719 B2
(45) **Date of Patent: *Sep. 30, 2003**

(54) METHOD OF MANUFACTURING ELECTRON-EMITTING DEVICE AS WELL AS ELECTRON SOURCE AND IMAGE-FORMING APPARATUS

(75) Inventors: Takeo Ono, Machida (JP); Hisaaki Kawade, Yokohama (JP); Yoshinobu Sekiguchi, Zama (JP); Yasuhiro Hamamoto, Machida (JP); Keisuke Yamamoto, Yamato (JP); Takeo Tsukamoto, Atsugi (JP); Masato Yamanobe, Machida (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/781,206

(22) Filed: Jan. 10, 1997

(65) Prior Publication Data

US 2002/0146958 A1 Oct. 10, 2002

Related U.S. Application Data

(62) Division of application No. 08/281,518, filed on Jul. 28, 1994, now Pat. No. 5,674,100.

(30) Foreign Application Priority Data

Jul. 20, 1994 (JP) ..... 6-167986

(51) Int. Cl.[7] ..... H01J 9/02
(52) U.S. Cl. ..... 445/24; 445/6
(58) Field of Search ..... 445/50, 51, 24; 313/336

(56) References Cited

U.S. PATENT DOCUMENTS

| | | | | |
|---|---|---|---|---|
| 4,160,745 A | * | 7/1979 | Murrell et al. | 252/447 |
| 5,185,554 A | * | 2/1993 | Nomura et al. | 313/336 X |
| 5,530,314 A | * | 6/1996 | Banno et al. | 313/310 |

FOREIGN PATENT DOCUMENTS

| | | | |
|---|---|---|---|
| EP | 536731 | * | 4/1993 |
| JP | 1-112631 | | 1/1989 |
| JP | 1-112631 | | 5/1989 |
| JP | 5-242793 | | 9/1993 |
| JP | 6-12997 | | 1/1994 |

OTHER PUBLICATIONS

M. Hartwell and C. Fonstad, Strong Electron Emission From Patterned Tin–Indium Oxide Thin Films, IEEE IEDM, Tech. Digest, Dec. 1, 1975, pp. 519–521.
IEEE Trans. E.D. Conf., Technical Digest, Washington, D.C., Dec. 1–3, 1975, pp. 520–521.

* cited by examiner

*Primary Examiner*—Kenneth J. Ramsey
(74) *Attorney, Agent, or Firm*—Fitzpatrick, Cella, Harper & Scinto

(57) ABSTRACT

An electron-emitting device comprises a pair of oppositely disposed electrodes and an electroconductive film inclusive of an electron-emitting region arranged between the electrodes. The electric resistance of the electroconductive film is reduced after forming the electron-emitting region in the course of manufacturing the electron-emitting device.

13 Claims, 20 Drawing Sheets

FIG. 10 SIMPLE MATRIX
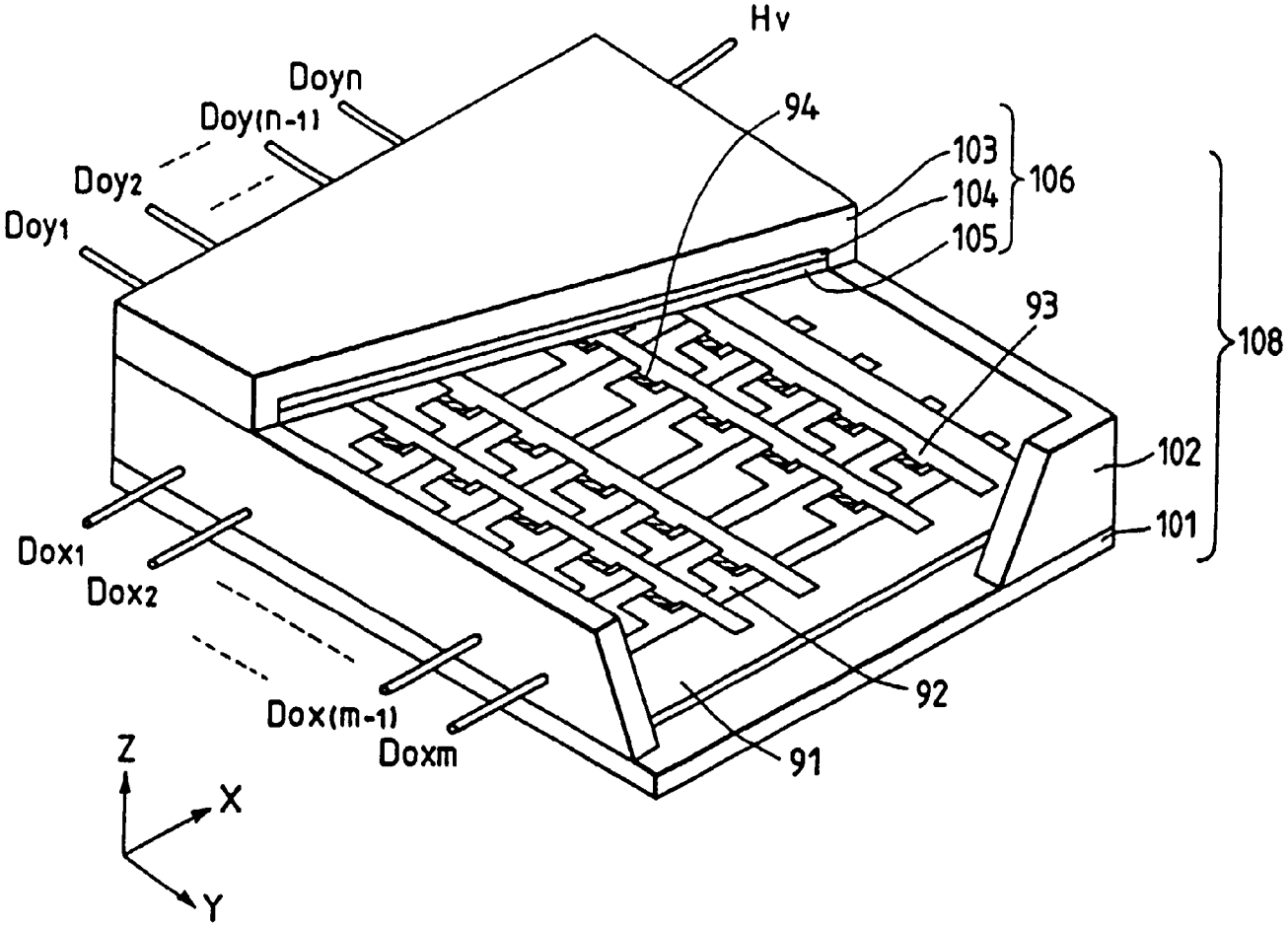

STRIPE

MATRIX

A-A' SECTION

METHOD OF MANUFACTURING ELECTRON-EMITTING DEVICE AS WELL AS ELECTRON SOURCE AND IMAGE-FORMING APPARATUS

This application is a division of application Ser. No. 08/281,518 filed Jul. 28, 1994, now U.S. Pat. No. 5,674,100.

BACKGROUND OF THE INVENTION

1. Field of the Invention

This invention relates to a method of manufacturing an electron-emitting device and it also relates to an electron source and an image-forming apparatus such as a display apparatus incorporating an electron-emitting device manufactured by such a method.

2. Related Background Art

There have been known two types of electron-emitting device; the thermoelectron type and the cold cathode type. Of these, the cold cathode type include the field emission type (hereinafter referred to as the FE-type), the metal/insulation layer/metal type (hereinafter referred to as the MIM-type) and the surface conduction type.

Examples of the FE electron-emitting device are described in W. P. Dyke & W. W. Dolan, "Field emission", Advance in Electron Physics, 8, 89 (1956) and C. A. Spindt, "PHYSICAL Properties of thin-film field emission cathodes with molybdenum cones", J. Appl. Phys., 47, 5248 (1976).

MIM devices are disclosed in papers including C. A. Mead, "The tunnel-emission amplifier", J. Appl. Phys., 32, 646 (1961).

Surface conduction electron-emitting devices are proposed in papers including M. I. Elinson, Radio Eng. Electron Phys., 10 (1965).

A surface conduction electron-emitting device is realized by utilizing the phenomenon that the electrons are emitted out of a small thin film formed on a substrate when an electric current is forced to flow in parallel with the film surface. While Elinson proposes the use of $SnO_2$ thin film for a device of this type, the use of Au thin film is proposed in G. Dittmer: "Thin Solid Films", 9, 317 (1972) whereas the use of $In_2O_3/SnO_2$ and that of carbon thin film are discussed respectively in M. Hartwell and C. G. Fonstad: "IEEE Trans. ED Conf.", 519 (1975) and in H. Araki et al.: "Vacuum", Vol. 26, No. 1, p.22 (1983).

FIG. 24 of the accompanying drawings schematically illustrates a typical surface conduction electron-emitting device proposed by M. Hartwell.

In FIG. 24, reference numeral 221 denotes a substrate. Reference numeral 224 denotes an electro-conductive film normally prepared as integrally with a pair of device electrodes 225, 226 by producing an H-shaped metal oxide thin film by means of sputtering, part of which eventually makes an electron-emitting region 223 when it is subjected to an electrically energizing process referred to as "electric forming" as described hereinafter. In FIG. 24, the horizontal area of the metal oxide thin film separating the pair of device electrodes 225, 226 has a length L of 0.5 to 1.0 mm and a width W of 0.1 mm. Note that the electron-emitting region 223 is only very schematically shown because there is no way to accurately know its location and contour.

As described above, the electroconductive film 224 of such a surface conduction electron-emitting device is normally subjected to an electrically energizing preliminary process, which is referred to as "electric forming", to produce an electron emitting region 223.

In the electric forming process, a DC voltage or a slowly rising voltage that rises typically at a rate of 1V/min. is applied to given opposite ends of the electroconductive film 224 to partly destroy, deform or transform the thin film and produce an electron-emitting region 223 which is electrically highly resistive. Thus, the electron-emitting region 223 is part of the electronductive film 224 that typically contains fissures therein so that electrons may be emitted from those fissures. Note that, once subjected to an electric forming process, a surface conduction electron-emitting device comes to emit electrons from its electron emitting region 223 whenever an appropriate voltage is applied to the electroconductive film 224 to make an electric current run through the device.

Since a surface conduction electron-emitting device as described above is structurally simple and can be manufactured in a simple manner, a large number of such devices can advantageously be arranged on a large area without difficulty. As a matter of fact, a number of studies have been made to fully exploit this advantage of surface conduction electron-emitting devices. Applications of devices of the type under consideration include charged electron beam sources and electronic displays.

In typical examples of application involving a large number of surface conduction electron-emitting devices, the devices are arranged in parallel rows to show a ladder-like shape and each of the devices are respectively connected at given opposite ends with wirings (common wirings) that are arranged in columns to form an electron source (as disclosed in Japanese Patent Application Laid-open Nos. 64-31332, 1-283749 and 1-257552).

As for display apparatuses and other image-forming apparatuses comprising surface conduction electron-emitting devices such as electronic displays, although flat-panel type displays comprising a liquid crystal panel in place of a CRT have gained popularity in recent years, such displays are not without problems. One of the problems is that a light source needs to be additionally incorporated into the display in order to illuminate the liquid crystal panel because the display is not of the so-called emission type and, therefore, the development of emission type display apparatuses has been eagerly expected in the industry.

An emission type electronic display that is free from this problem can be realized by using an electron source prepared by arranging a large number of surface conduction electron-emitting devices in combination with fluorescent bodies that are made to shed visible light by electrons emitted from the electron source (See, for example, U.S. Pat. No. 5,066,883).

For a surface conduction electron-emitting device of the above described type, the electroconductive film is desirably made of a metal oxide having an electric resistance sufficiently greater than that of a metal film as in the case of the above described M. Hartwell's electroconductive film 224 (FIG. 24). This is because a large electric current is required for the electric forming operation if the electroconductive film 224 has a low electric resistance when the electron-emitting region is produced by electric forming. The required electric current will be huge and beyond any practical level particularly when a large number of surface conduction electron-emitting devices need to be simultaneously subjected to an electric forming operation in the process of manufacturing an electron source comprising a plurality of surface conduction electron-emitting devices.

On the other hand, an electron source comprising a plurality of surface conduction electron-emitting devices and an image-forming apparatus incorporating such an electron source can be driven only by consuming electric power at an enhanced rate if the electroconductive film of each device has a high electric resistance.

SUMMARY OF THE INVENTION

In view of the above identified technological problems, it is therefore an object of the present invention to provide a method of manufacturing an electron-emitting device that can effectively reduce the drive voltage and the power consumption level of the device.

Another object of the invention is to provide an electron source and an image-forming apparatus that operate on a power saving basis.

Still another object of the invention is to provide an electron source comprising a plurality of electron-emitting devices that operate uniformly for electron emission and an image-forming apparatus incorporating such an electron source and capable of displaying high quality images.

A further object of the present invention is to provide a method of manufacturing an electron-emitting device that can effectively reduce the electric current for electric forming and the, power consumption level required for driving the device as well as an energy saving electron source comprising a plurality of such electron-emitting devices that operate uniformly for electron emission and an image-forming apparatus incorporating such an electron source and capable of displaying high quality images.

According to a first aspect of the invention, the above objects and other objects of the invention are achieved by providing a method of manufacturing an electron-emitting device comprising a pair of oppositely disposed electrodes and an electroconductive film inclusive of an electron-emitting region arranged between said electrodes characterized in that said method comprises a processing step of reducing the electric resistance of the electroconductive film arranged between the electrodes.

Preferably, said processing step of reducing the electric resistance of the electroconductive film arranged between the electrodes is a step of chemically reducing the electroconductive film.

According to a second aspect of the invention, there is provided an electron source comprising an electron-emitting device for emitting electrons as a function of input signals characterized in that said electron-emitting devices are produced by said manufacturing method.

According to a third aspect of the invention, there is provided an image-forming apparatus comprising an electron source and an image-forming member for forming images as a function of input signals characterized in that said electron source is an electron source comprising an electron-emitting device produced by said manufacturing method.

BRIEF DESCRIPTION OF THE DRAWINGS

FIG. 10 is a schematic perspective view of the display panel of an image-forming apparatus comprising an electron source having a simple matrix arrangement of electron-emitting devices.

DESCRIPTION OF THE PREFERRED EMBODIMENTS

Now, the present invention will be described in greater detail by referring to the accompanying drawings.

According to an aspect of the invention, there is provided a method of manufacturing an electron-emitting device comprising an electroconductive film as a component thereof, wherein said method comprises a processing step of reducing the electric resistance of the electroconductive film so that the voltage to be applied to and the power consumed by the electron-emitting device may be significantly reduced.

The processing step of reducing the electric resistance of the electroconductive film of an electron-emitting device will be described by referring to FIGS. 1A, 1B and 2.

Figure 1A:
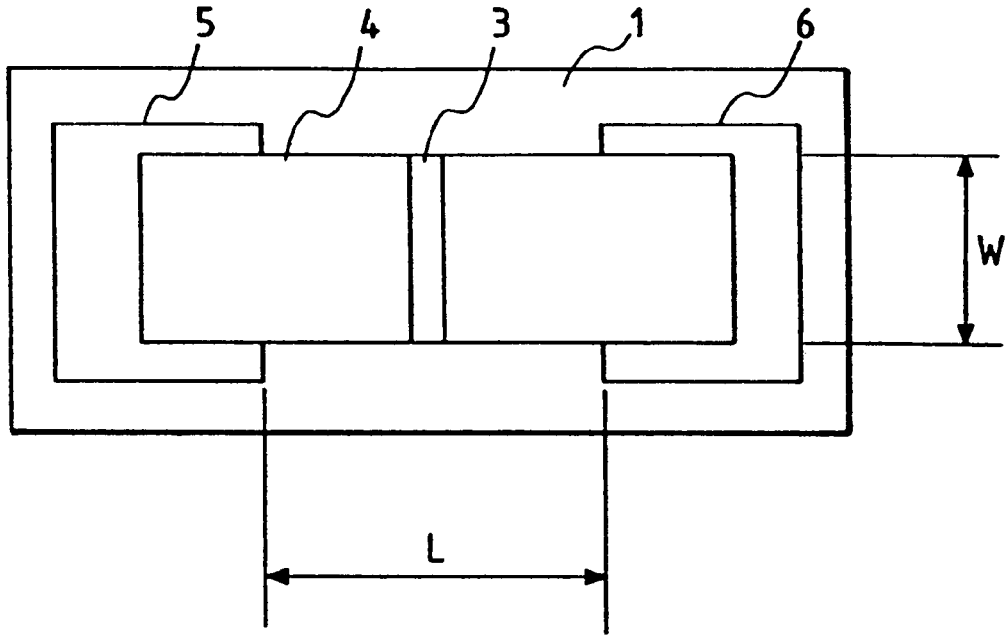
FIG. 1A shows a schematic plan view of a surface conduction electron-emitting device produced by a manufacturing method according to the invention and FIG. 1B shows an equivalent circuit for driving the device.

FIG. 1A shows a schematic plan view of a surface conduction electron-emitting device produced by a manufacturing method according to the invention and comprising a pair of electrodes 5, 6 and an electroconductive film 4 inclusive of an electron-emitting region 3 arranged between the electrodes. Note that reference numeral 1 denotes an insulating substrate and the electron-emitting region 3 contains fissures to make itself electrically highly resistive.

When a certain voltage is applied to the electroconductive film 4 by an external power source via the electrodes 5, 6 to cause an electric current to flow therethrough, the electron-emitting region 3 emits electrons.

Figure 1B:
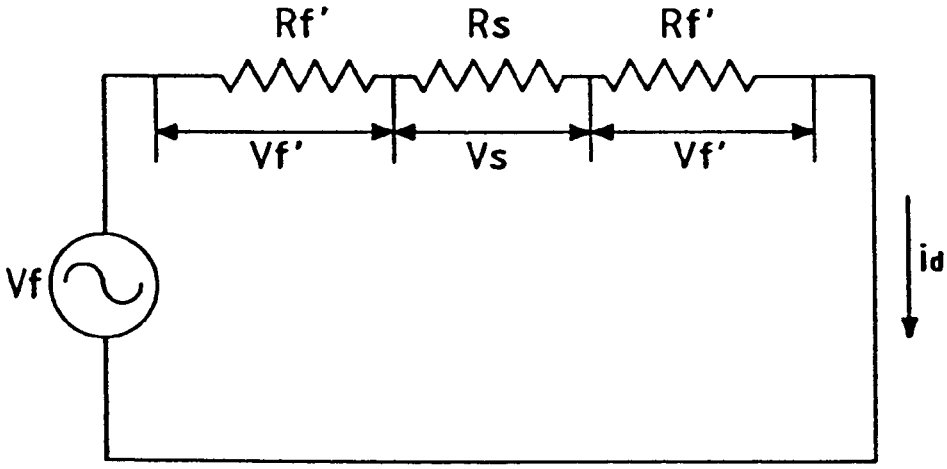

FIG. 1B shows an equivalent circuit for driving the electron-emitting device.

Referring to FIG. 1B, Rs and Rf respectively denote the electric resistance of the electron-emitting region 3 and that of each of the oppositely arranged remaining portions of the electroconductive film 4. While the oppositely disposed portions of the electroconductive film 4 other than the electron emitting region 3 may have different values for electric resistance from each other, it is assumed here for the same,of convenience that the electron emitting region 3 is arranged exactly in the middle between the electrodes and the remaining portions of the electroconductive film 4 have electric resistances that are equal to each other.

If the electric current required to cause the electron-emitting device to emit electrons is id and the voltage required to be applied to the device in order to cause the current id to flow through the device is Vf, the power consumption rate P(all) of the electron-emitting device is expressed by equation $P(all)=Vf \cdot id$.

It should be noted here that P(all) include the effective power consumption rate $Ps=Rs \cdot id$ that represents the power consumed per unit time genuinely by the electron emitting region in order to emit electrons and the ineffective power consumption rate $Pf'=2 \cdot Rf' id^2$ that represents the power consumed per unit time by the remaining portions of the electroconductive film 4 that are connected in series to the electron emitting region 3.

While the above description concerns a single electron-emitting device, the overall ineffective power consumption rate would become enormous for an electron source comprising a plurality of such electron-emitting devices and hence for an image-forming apparatus incorporating such an electron source.

The drive voltage and the power consumption rate of the electron-emitting device can be reduced by reducing the ineffective power consumption rate Pf', that is, by making the electric resistance of the portions of the electroconductive film 4 Rf' (hereinafter referred to as the electric resistance of the electroconductive film 4) sufficiently small relative to the electric resistance of the electron emitting region 3 per se.

If the electric resistance per unit square of the electroconductive film 4 is Ro□, then the electric resistance of the electroconductive film 4 Rf' is expressed by $Rf'=[L/(2 \cdot W)] \cdot Ro$=. While Rf' can be made smaller by reducing the distance L between the electrodes 5 and 6 (hereinafter referred to as gas length), a small value for L is not desirable because it can seriously damage the flexibility with which the entire electron-emitting device is to be designed.

More specifically, for an image-forming apparatus having a large display screen, the distance L between the electrode 5 and 6 of each electron-emitting device of the apparatus is preferably not smaller than 3pm and more preferably not smaller than tens of several pm from the view point of the currently available level of performance of the aligner, the accuracy of printing, the yield and other manufacturing considerations for patterning the electrodes.

In view of the above technological restrictions, the present invention is intended to provide a method of manufacturing a surface conduction electron-emitting device comprising a pair of oppositely disposed electrodes and an electroconductive film inclusive of an electron-emitting region arranged between said electrodes characterized in that said method comprises a processing step of reducing the electric resistance of the electroconductive film arranged between the electrodes.

Preferably, said processing step of reducing the electric resistance of the electroconductive film arranged between the electrodes is a step of chemically reducing the electroconductive film. With such an operation of chemically reducing the electroconductive film 4, the ineffective power consumption rate Pf' of the electroconductive film 4 can be significantly reduced to allow electric power to be effectively consumed for electron emission in the device.

Now, the relationships between the device current If and the device voltage Vf and between the emission current Ie and the device voltage Vf before and after the chemical reduction step of an electron-emitting device being produced by a manufacturing method according to the invention will be described schematically by referring to FIG. 2. In FIG. 2, the device current and the emission current before chemical reduction are respectively indicated by Ifo and Ieo whereas those after chemical reduction are respectively denoted by Ifm and Iem.

Figure 2:
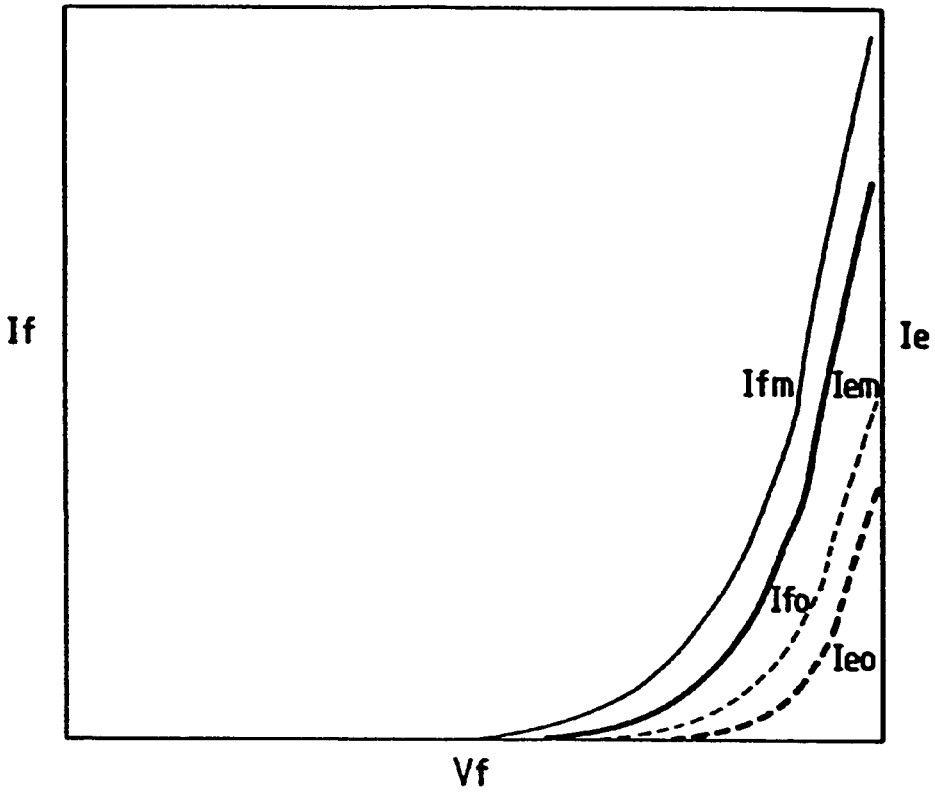
FIG. 2 is a graph showing the relationships between the device current and the device voltage and between the emission current and the device voltage before and after the chemical reduction step of an electron-emitting device being produced by a manufacturing method according to the invention.

As clearly seen from FIG. 2, both Ifo and Ieo before chemical reduction are smaller than their respective counterparts Ifm and Iem after chemical reduction. This means that almost all the device voltage Vf applied to the electron-emitting device is applied to the electron emitting region after the operation of chemical reduction, whereas the device voltage Vf is significantly lowered by the resistance of the electroconductive film and only a fraction of the device voltage Vf is actually applied to the electron emitting region before the chemical reductions step. In other words, a higher device voltage needs to be applied to the electron-emitting device before the chemical reduction step in order to compensate the loss in the electroconductive film if an emission current level equal to the level after the chemical reduction step is to be achieved before the chemical reduction step in the electron-emitting device. Then, electric power will be consumed by the electroconductive film at an even higher rate.

Thus, according to the invention, the power consumption rate of an electron-emitting device can be reduced by chemically reducing the electroconductive film. Preferable alternative techniques for chemically reducing the electroconductive film for the purpose of the present invention include 1) heating the film in vacuum, 2) keeping the film in an reducing atmosphere and 3) keeping the film in a reducing solution. With any of these techniques, the operation of chemically reducing the electroconductive film is conducted, while monitoring the electric resistance of the electroconductive film, until the resistance gets to a stable level and does not become lower any further.

Now, the best mode of carrying out the invention will be described.

Firstly, a method of manufacturing a surface conduction electron-emitting device according to the invention will be described by referring to FIGS. 3A–3C that show a surface conduction electron-emitting device in three different manufacturing steps.

A method of manufacturing a surface conduction electron-emitting device according to the invention comprises the following steps.

(A) Steps up to electric forming: the electroconductive film arranged between a pair of electrodes on a substrate is subjected to an electric forming operation.

Figure 3A:
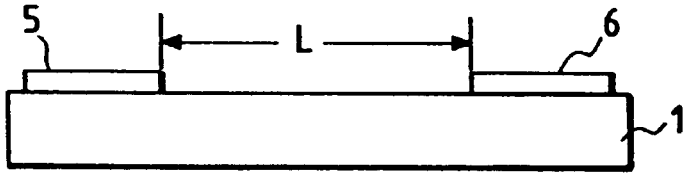
FIGS. 3A to 3C show schematic sectional views of an electron-emitting device in different steps of manufacturing by a method according to the invention.

1) After thoroughly cleansing a substrate 1 with detergent and pure water, a material is deposited on the substrate 1 by means of vacuum deposition, sputtering or some other appropriate technique for a pair of device electrodes 5 and 6, which are then produced by photolithography (FIG. 3A).

2) An organic metal thin film is formed on the substrate 1 between the pair of device electrodes 5 and 6 by applying an organic metal solution and leaving the applied solution for a given period of time. Thereafter, the organic metal thin film is heated in an oxidizing atmosphere, for instance, in the ambient air atmosphere, and is charged to an electroconductive film which comprises mainly metal oxides and subsequently subjected to a patterning operation, using an appropriate technique such as lift-off or etching, to produce a thin film 2 for forming an electron-emitting region (FIG. 3B). While an organic metal solution is used to produce a thin film in the above description, a thin film may alternatively be formed by vacuum deposition, sputtering, chemical vapor phase deposition, dispersed application, dipping, spinner or some other technique.

3) Thereafter, the device is subjected to an electric forming process.

In this electric forming operation, the electroconductive film 4 is locally destroyed, deformed or transformed such that a portion of the electroconductive film 4 undergoes a structural change (to become a high electric resistance area) as fissures are formed there. Differently stated, a portion of the electroconductive film 4 undergoes a structural change to make an electron emitting region 3 in an electric forming process where a voltage is applied to the device electrodes 5 and 6 by a power source (not shown) to energize the electroconductive film 4 (FIG. 3C).

All the remaining steps of the electric processing to be conducted on the device after the forming operation are carried out by using a measuring system which will be described below by referring to FIG. 4.

Figure 4:
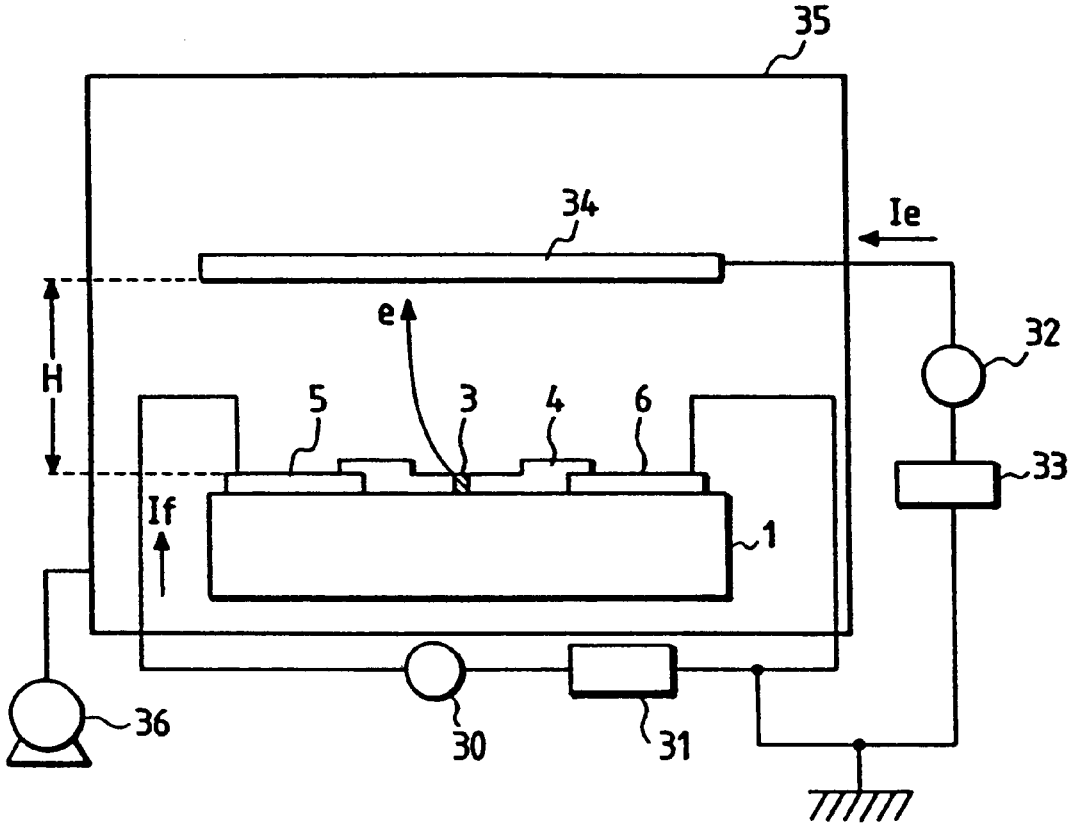
FIG. 4 is a schematic diagram showing the configuration of a measuring system for determining the performance of an electron-emitting device.

Referring to FIG. 4, the measuring system comprises a power source 31 for applying a voltage to the device, an ammeter 30 for metering the device current If running through the electroconductive film 4 between the device electrodes, an anode 34 for capturing the emission current Ie emitted from the electron-emitting region 3 of the device, a high voltage source 33 for applying a voltage to the anode 34 of the measuring system, another ammeter 32 for metering the emission current Ie emitted from the electron-emitting region 3 of the device, a vacuum apparatus 35 and an exhaust pump 36. The exhaust pump may be provided with an ordinary high vacuum system comprising a turbo pump and a rotary pump or an oil-free high vacuum system comprising an oil-free pump such as a magnetic levitation turbo pump or a dry pump and an ultra-high vacuum system comprising an ion pump.

An electron-emitting device is placed in the vacuum apparatus 35 for carrying out the remaining steps of electric processing or for measuring the performance of the device, which comprises a substrate 1, a pair of device electrodes 5 and 6 and an electroconductive film 4 including an electron emitting region 3 as shown in FIG. 4.

The vacuum apparatus 35 is provided with a vacuum gauge and other pieces of equipment necessary to operate it so that the measuring operation can be conducted under a desired vacuum condition.

The vacuum chamber and the substrate of the electron source can be heated to approximately 400° C. by means of a heater (not shown).

For determining the performance of the device, a voltage between 1 and 10 KV is applied to the anode, which is spaced apart from the electron emitting device by distance H which is between 2 and 8 mm.

Figure 5A:
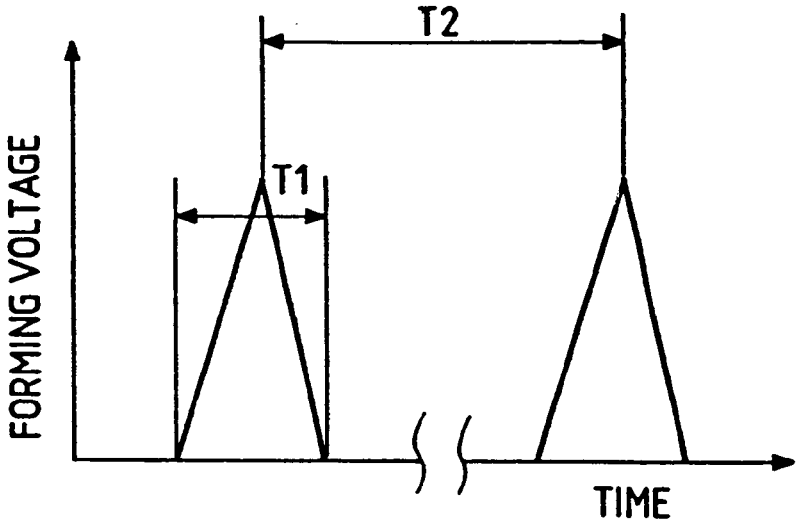
FIGS. 5A and 5B show forming voltage waveforms that can suitably be used for the purpose of the present invention.
Figure 5B:
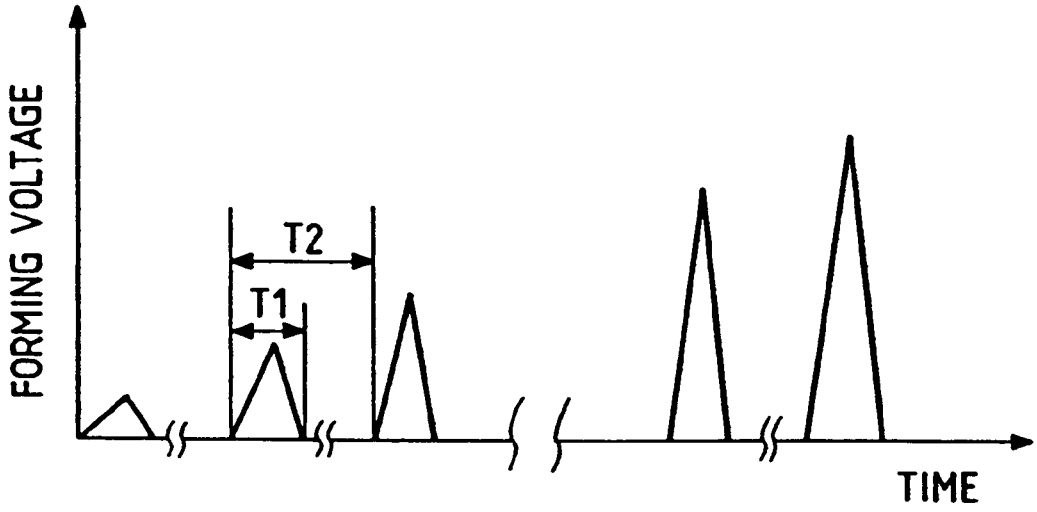

For the electric forming operation, a constant pulse voltage or an increasing pulse voltage may be applied. FIGS. 5A and 5B show two possible electric forming voltage waveforms.

For the purpose of the present invention, the voltage to be applied to the device for an electric forming operation preferably have a pulse waveform. FIG. 5A shows a constant pulse waveform where the pulse wave height is constant, whereas FIG. 5B shows an increasing pulse waveform where the pulse wave height increases with time.

Firstly, a voltage having a constant pulse wave height will be described by referring to FIG. 5A.

Referring to FIG. 5A, the pulse voltage has a pulse width T1 and a pulse interval T2, which are between 1 microsecond and 10 microseconds and between 10 microseconds and 100 milliseconds respectively. The height of the triangular wave (the peak voltage for the electric forming operation) may be appropriately selected depending on the profile of the electron-emitting device to be processed and the voltage is applied for several seconds to several tens of minutes under an appropriate vacuum conditions, for instance, typically with a degree of vacuum of approximately $10^{-5}$ torr. Note that the pulse waveform to be applied to the device electrodes is not limited to a triangular waveform and may alternatively be a rectangular waveform or some other appropriate waveform.

Secondly, a voltage having an increasing waveform will be described by referring to FIG. 5B.

Referring to FIG. 5B, the pulse voltage has a width T1 and a pulse interval T2, which are between 1 microsecond and 10 microseconds and between 10 microseconds and 100 milliseconds respectively as in the case of FIG. 5A, although the height of the triangular wave (the peak voltage for the electric forming operation) is increased at a rate of, for instance, 0.1V per step and the voltage is applied to the device in vacuum.

The electric forming operation will be terminated when typically a resistance greater than 1M ohms is observed for the device current. If running through the electroconductive thin film 4 for forming an electron-emitting region while applying a resistance-measuring voltage of approximately 0.1V is applied to the device electrodes not to locally destroy or deform the thin film.

(B) Reduction of electric resistance: the electroconductive film arranged between a pair of electrodes is subjected to a processing operation of reducing the electric resistance thereof.

4) The processing operation of reducing the electric resistance of the electroconductive film is an operation of chemically reducing the electroconductive film.

The processing operation of chemically reducing the electroconductive film 4 including an electron-emitting region 3 arranged between a pair of device electrodes 5 and 6 on a substrate 1 is conducted in a manner as described below. In this operation, a monitoring device that has been subjected only to steps 1) and 2) of (A) and not to the electric forming operation is preferably used along with the device to be processed so that the end of the operation of chemically reducing the electroconductive film 4 of the device may be determined by observing changes in the resistance of the electroconductive film 4 of the monitoring device that has not been electrically formed and is concurrently subjected to the operation of chemical reduction.

Techniques that can be used for chemically reducing the electroconductive film 4 include the following.

(1) Heating the Film in Vacuum

The heating temperature for this technique is preferably between 100° C. and 400° C., although it depends on the degree of vacuum involved and the components of the electroconductive film.

(2) Keeping the Film in a Reducing Atmosphere

Gaseous substances that can be used for this technique include hydrogen, hydrogen sulfide, hydrogen iodide, carbon monoxide, sulfur dioxide and other lower gaseous oxides. The heating temperature for this technique is preferably between room temperature (20° C.) and 400° C., although it depends on the gaseous substance involved.

(3) Keeping the Film in a Reducing Solution

Reducing solutions that can be used for this technique include solutions of hydrazine, diimides, formic acid, aldehydes and L-ascorbic acid. The heating temperature for this technique is preferably between 20° C. and 100° C.

5) The device that has undergone the above steps is then subjected to an activation step which will be described below.

In this activation step, a pulse voltage having a constant wave height is repeatedly applied to the device in vacuum of a degree typically between $10^{-4}$ and $10^{-5}$ torr as in the case of the forming operation so that carbon or carbon compounds may be deposited on the device out of the organic substances existing in the vacuum in order to cause the device current If and the emission current Ie of the device to change markedly and obtain an electron-emitting device having a high emission current Ie and a high electron emission efficiency ((Ie/If)×100[%]).

The carbon or carbon compounds as referred to above are found to be mostly graphite (both mono- and poly-crystalline) and non-crystalline carbon (or a mixture of amorphous carbon and poly-crystalline graphite) if observed through a TEM or a Raman spectroscopes and the thickness of the film deposited is preferably less than 500 angstroms and more preferably less than 300 angstroms.

For the purpose of the present invention, the activation step preferably precedes the chemical reduction step.

More specifically, the electroconductive film 4 may show deformation on the surface due to agglomeration in the course of the chemical reduction process to make the electron-emitting region 3 partly short-circuited depending on the components of the electroconductive film 4 and/or the conditions for the operation of chemical reduction. Once such a short-circuited state takes place, the device current If can be increased to consequently reduce the ratio of the electron emission current Ie to the device current If.

The reduction in the ratio of the electron emission current Ie to the device current If can be prevented by forming a coating film on the electroconductive film 4 at a location near the electron-emitting region 3 at the time of deposition of carbon or carbon compounds in the activation step in order to suppress any possible agglomeration and consequent deformation of the electroconductive film 4 in the succeeding chemical reduction step.

6) The prepared electron-emitting device is preferably driving to operate in vacuum of a degree higher than those of the electric forming step and the activation steps. Preferably, the device is heated at 80° C. to 150° C. in vacuum of such a high degree. The degree of vacuum higher than those of the electric forming step and the activation step typically means a vacuum of not higher than $10^{-6}$ torr and, preferably an ultra-high vacuum state under which carbon and carbon compounds would not be additionally deposited.

Thus, any additional deposition of carbon and/or carbon compounds is suppressed to stabilize both the device current If and the emission current lie.

Now, some of the basic features of an electron-emitting device according to the invention and prepared in the above described manner will be described below by referring to FIG. 6.

Figure 6:
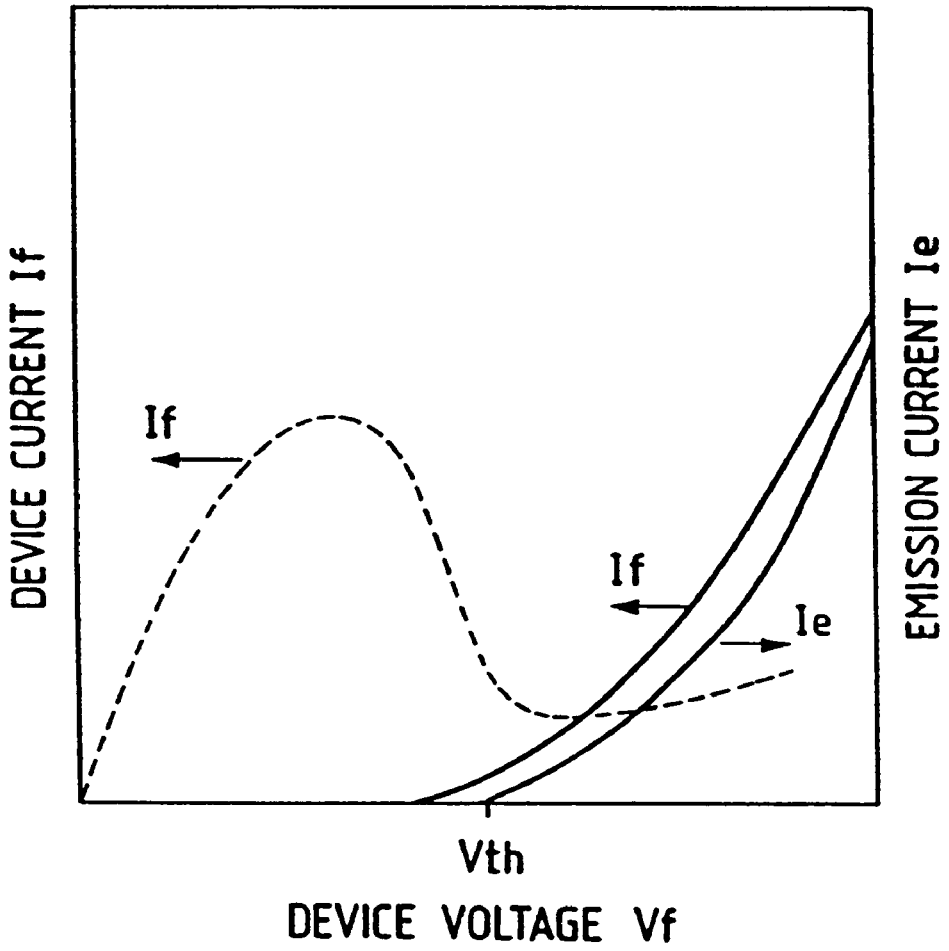
FIG. 6 is a graph showing a typical relationships between the emission current Ie and the device voltage Vf and between the device current If and the device voltage Vf of a surface conduction electron-emitting device produced by a manufacturing method according to the invention.

FIG. 6 shows a graph schematically illustrating the relationship between the device voltage Vf and the emission current Ie and between the device voltage Vf and the device current If typically observed by the measuring system of FIG. 4. Note that different units are arbitrarily s elected for Ie and If in FIG. 6 in view of the fact that Ie has a magnitude by far smaller than that of If.

As seen in FIG. 6, an electron-emitting device according to the invention has three remarkable features in terms of emission current Ie, which will be described below.

Firstly, an electron-emitting device according to the invention shows a sudden and sharp increase in the emission current Ie when the voltage applied thereto exceeds a certain level (which is referred to as a threshold voltage hereinafter and indicated by Vth in FIG. 6), whereas the emission current Ie is practically undetectable when the applied voltage is found lower than the threshold value Vth. Differently stated, an electron-emitting device according to the invention is a non-linear device having a clear threshold voltage Vth to the emission current Ie.

Secondly, since the emission current Ie is highly dependent on the device voltage Vf, the former can be effectively controlled by way of the latter.

Thirdly, the emitted electric charge captured by the anode 34 is a function of the duration of time of application of the device voltage Vf. In other words, the amount of electric charge captured by the anode 34 can be effectively controlled by way of the time during which the device voltage Vf is applied.

Note that the device current If either monotonically increases relative to the device voltage Vf (as shown by a solid line in FIG. 6, a characteristic referred to as MI characteristic hereinafter) or changes to show a form specific to a voltage-controlled-negative-resistance characteristic (as shown by a broken line in FIG. 6, a characteristic referred to as VCNR characteristic hereinafter). These characteristics of the device current are dependent on a number of factors including the manufacturing method, the conditions where it is measured and the environment for operating the device. The MI characteristic is preferably used for the purpose of the present invention.

Now, a flat type surface conduction electron-emitting device will be described.

Figure 7A:
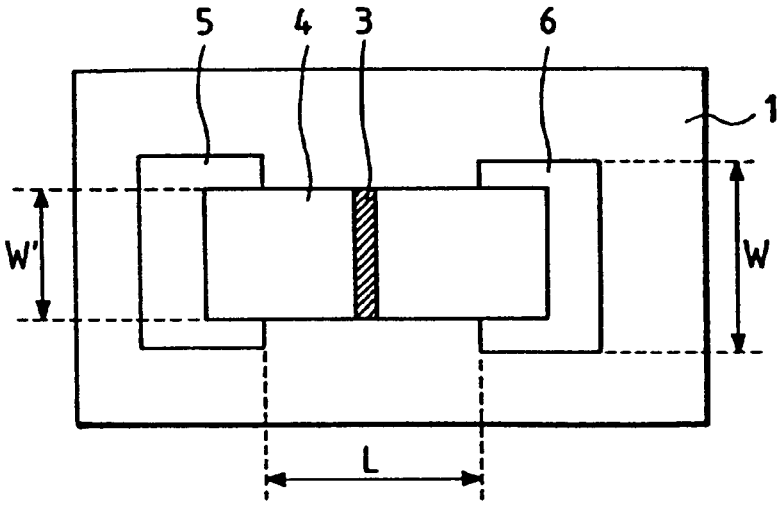
FIGS. 7A and 7B schematically show a plan view and a sectional view, respectively, of a surface conduction electron-emitting device produced by a manufacturing method according to the invention.
Figure 7B:
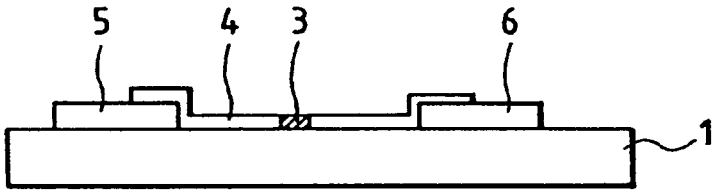

FIGS. 7A and 7B respectively show a schematic plan view and a schematic sectional view of a surface conduction electron-emitting device produced by a manufacturing method according to the invention. Referring to FIGS. 7A and 7B, the device comprises a substrate 1, a pair of device electrodes 5 and 6, a thin film 4 including an electron-emitting region 3.

Materials that can be used for the substrate 1 include quartz glass, glass containing impurities such as Na to a reduced concentration level, soda lime glass, glass substrate realized by forming an $SiO_2$ layer on soda lime glass by means of sputtering, ceramic substances such as alumina.

While the oppositely arranged device electrodes 5 and 6 may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, $RuO_2$, Pd-Ag and glass, transparent electroconductive materials such as $In_2$ O—$SnO_2$ and semiconductor materials such as polysilicon.

The distance L separating the device electrodes, the length W of the device electrodes, the contour of the electroconductive film 4 and other factors for designing a surface conduction electron-emitting device according to the invention may be determined depending on the application of the device. The distance L is preferably between several hundreds angstroms and several hundreds micrometers and, still preferably, between several micrometers and tens of several micrometers depending on the voltage to be applied to the device electrodes and the field strength available for electron emission.

The electroconductive thin film 4 is preferably a fine particle film in order to provide excellent electron-emitting characteristics. The thickness of the electroconductive thin film 4 is determined as a function of the stepped coverage of the thin film on the device electrodes 5 and 6, the electric resistance between the device electrodes 5 and 6 and the parameters for the forming operation that will be described later as well as other factors and preferably between several angstroms and several thousands angstroms and more preferably between ten angstroms and five hundreds angstroms.

The electroconductive film 4 is typically made of fine particles of a material selected from metals such as Pd, Ru, Ag, Ti, In, Cu, Cr, Fe, Zn, Sn, W and Pb after processed in the above described chemical reduction step, although it may contain oxides of those metals such as PdO, $SnO_2$, $In_2O_3$, PbO, MoO and $MoO_2$.

The term "a fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is between several angstroms and several thousands angstroms and preferably between ten angstroms and two hundreds angstroms.

The electron-emitting region 3 is part of the electroconductive thin film 4 and comprises electrically highly resistive fissures, although its profile is dependent on the thickness and the material of the electroconductive thin film 4 and the electric forming process described earlier. It may contain electroconductive fine particles having a diameter between several angstroms and hundreds of several angstroms. The material of such fine particles may be formed of all or part of the materials that are used to prepare the electroconductive thin film 4. The electroconductive thin film 4 preferably contains carbon and carbon compounds in the electron-emitting region 3 and its neighboring areas.

Now, a step type surface conduction electron-emitting device, will be described.

Figure 8:
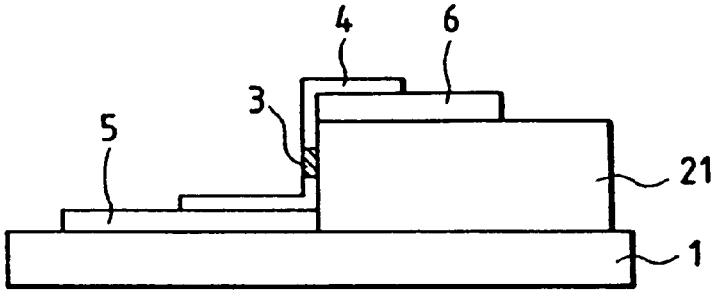
FIG. 8 schematically shows a sectional view of a surface conduction electron-emitting device of a type different from that of the device of FIGS. 7A and 7B produced by a manufacturing method according to the invention.

FIG. 8 is a schematic sectional view of a step type surface conduction electron-emitting device, showing its basic configuration. The components same as or similar to those of the device of FIGS. 7A and 7B a respectively denoted by the same reference symbols.

The device comprises a substrate 1, a pair of device electrodes 5 and 6 and a electroconductive film 4 including an electron emitting region 3, which are made of materials same as a flat type surface conduction electron-emitting device as described above, as well as a step-forming section 21 made of an insulating material such as $SiO_2$ produced by vacuum deposition, printing or sputtering and having a film thickness corresponding to the distance L separating the device electrodes of a flat type surface conduction electron emitting device as described above, or between several hundreds angstroms and tens of several micrometers are preferably between several hundreds angstroms and several micrometers, although it is selected as a function of the method of producing the step-forming section used there, the voltage to be applied to the device electrodes and the field strength available for electron emission.

As the electroconductive film 4 is formed after the device electrodes 5 and 6 and the step-forming section 21, it may preferably be laid on the device electrodes 5 and 6. The location and contour of the electron-emitting region 3 are dependent on the conditions under which it is prepared, electric forming conditions and other related conditions and not limited to the location and contour shown in FIG. 8.

Since an electron-emitting device produced by a method according to the invention is provided with the above described three remarkable features, its electron-emitting performance can be easily and accurately controlled as a function of input signals even if it is used as one of a plurality of identical electron-emitting devices comprised in an electron source or an image-forming apparatus incorporating such an electron source.

Then, an electron source and an image-forming apparatus comprising electron-emitting devices produced by a manufacturing method according to the invention will be described in terms of their respective basic configurations.

An electron source and an image-forming apparatus can be realized by arranging a plurality of electron-emitting devices on a substrate. Electron-emitting devices may be arranged on a substrate in a number of different modes. For instance, a number of surface conduction electron-emitting devices as described earlier may be arranged in rows along a direction (hereinafter referred to row-direction), each device being connected by wirings at opposite ends thereof, and driven to operate by control electrodes (hereinafter referred to as grids or modulation means) arranged in a space above the electron-emitting devices along a direction perpendicular to the row direction (hereinafter referred to as column-direction) or, alternatively as described below, a total of m X-directional wirings and a total of n Y-directional wirings are arranged with an interlayer insulation layer disposed between the X-directional wirings and the Y-directional wirings along with a number of surface conduction electron-emitting devices such that the pair of device electrodes of each surface conduction electron-emitting device are connected respectively to one of the X-directional wirings and one of the Y-directional wirings. The latter arrangement is referred to as a simple matrix arrangement.

Now, the simple matrix arrangement will be described in detail.

In view of the three basic features of a surface conduction electron-emitting device according to the invention, each of the surface conduction electron-emitting devices in a configuration of simple matrix arrangement can be controlled for electron emission by controlling the wave height and the pulse width of the pulse voltage applied to the opposite electrodes of the device above the threshold voltage level. On the other hand, the device does not emit any electron below the threshold voltage level. Therefore, in the case of a number of electron-emitting devices, desired surface conduction electron-emitting devices can be selected and controlled for electron emission in response to the input signal by applying a pulse voltage to each of the selected devices.

Figure 9:
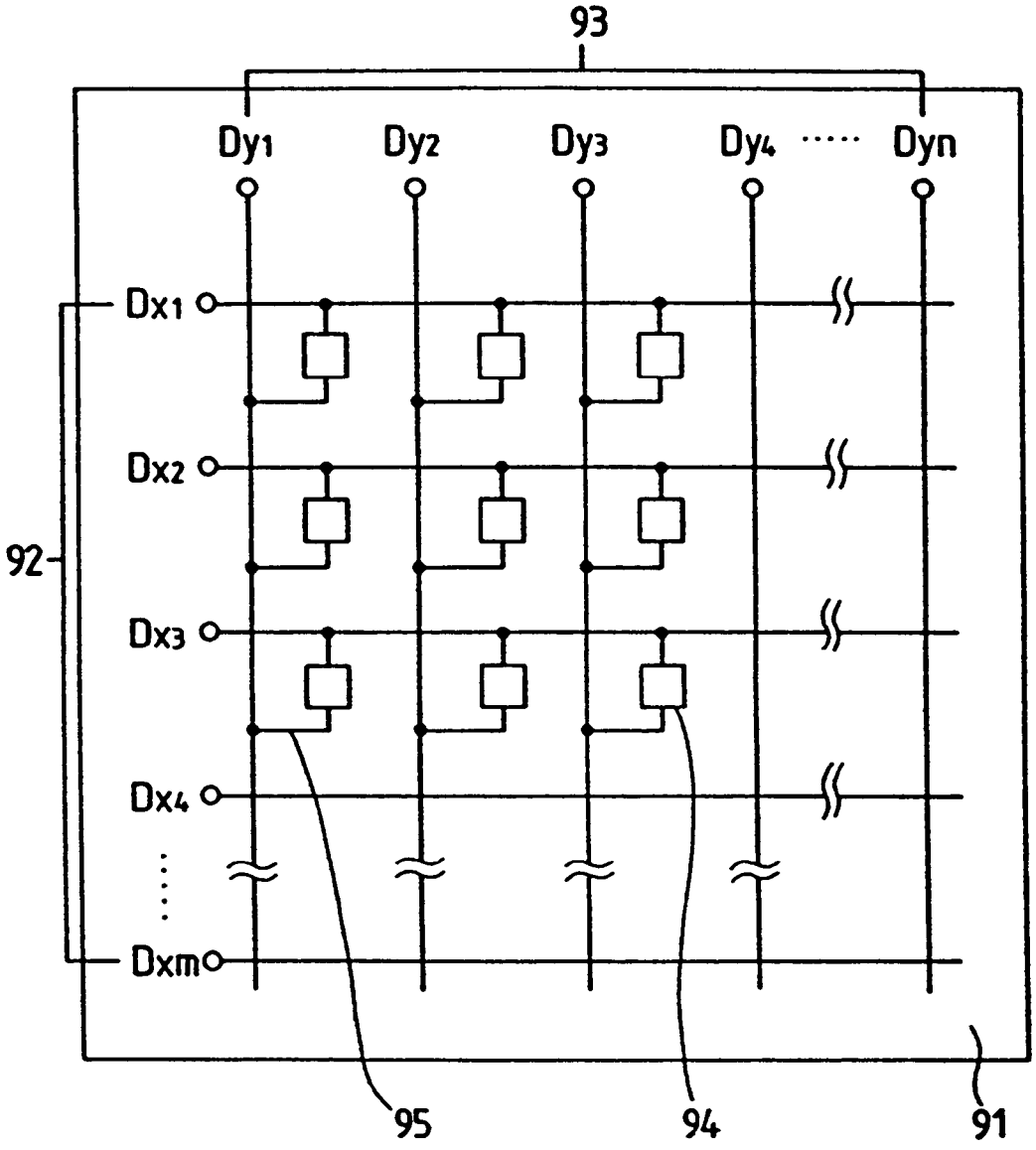
FIG. 9 is a schematic plan view of an electron source having a simple matrix arrangement of electron-emitting devices.

FIG. 9 is a schematic plan view of the substrate of an electron source according to the invention realized by using the above features. In FIG. 9, the electron source comprises a substrate 91 carrying a plurality of surface conduction electron-emitting devices arranged thereon (hereinafter referred to a electron source substrate), X-directional wirings 92 Y-directional wirings 93, surface conduction electron-emitting devices 94 and connecting wires 95. The surface conduction electron-emitting devices may be either of the flat type or of the step type. In FIG. 9, the electron source substrate 91 may be a glass substrate and the number and configuration of the surface conduction electron-emitting devices arranged on the substrate may be appropriately determined depending on the application of the electron source.

There are provided a total of m X-directional wirings 92, which are donated by DX1, DX2, . . . , DXm and made of an electroconductive metal formed by vacuum deposition, printing or sputtering. These wirings are so designed in terms of material, thickness and width that a substantially equal voltage may be applied to the surface conduction electron-emitting devices. A total of n Y-directional wirings are arranged and donated by DY1, DY2, . . . , DYn, which are similar to the X-directional wirings 92 in terms of material, thickness and width. An interlayer insulation layer (not shown) is disposed between the m X-directional wirings 92 and the n Y-directional wirings 93 to electrically isolate them from each other, the m X-directional wirings and n Y-directional wirings forming a matrix. Note that m and n are integers.

The interlayer insulation layer (not shown) is typically made of $SiO_2$ and formed on the entire surface or part of the surface of the insulating substrate 91 to show a desired contour by means of vacuum deposition, printing or sputtering. The thickness, material and manufacturing method of the interlayer insulation layer are so selected as to make it withstand any potential difference between an X-directional wiring 92 and a Y-directional wiring 93 at the crossing thereof. Each of the X-directional wirings 92 and the Y-directional wirings 93 is drawn out to form an external terminal.

The oppositely arranged electrodes (not shown) of each of the surface conduction electron-emitting devices 94 are connected to the related one of the m X-directional wirings 92 and the related one of the n Y-directional wirings 93 by respective connecting wires 95 which are made of an electroconductive metal and formed by vacuum deposition, printing or sputtering.

The electroconductive metal material of the device electrodes and that of the connecting wires 95 extending from the m X-directional wirings 92 and the n Y-directional wirings 93 may be same or contain common elements are components, the latter being appropriately selected depending on the former. If the device electrodes and the connecting wires are made of a same material, they may be collectively called device electrodes without discriminating the connecting wires. The surface conduction electron-emitting devices may be arranged directly on the substrate 91 or on the interlayer insulation layer (not shown).

As will be described in greater detail hereinafter, the X-directional wirings 92 are electrically connected to a scan signal generating means (not shown) for applying a scan signal to a selected row of surface conduction electron-emitting devices 94 and scanning the selected row according to an input signal.

On the other hand, the Y-directional wirings 93 are electrically connected to a modulation signal generating means (not shown) for applying a modulation signal to a selected column of surface conduction electron-emitting devices 94 and modulating the selected column according to an input signal.

Note that the drive signal to be applied to each surface conduction electron-emitting device is expressed as the voltage difference of the scan signal and the modulation signal applied to the device.

With the arrangement of simple matrix wiring as described above, an electron source according to the invention can selectively and independently drive individual electron-emitting devices.

Now, an image-forming apparatus according to the invention and comprising an electron source having a simple matrix arrangement as described above will be described by referring to FIGS. 10, 11A, 11B and 12. This apparatus may be a display apparatus.

Figure 11A:
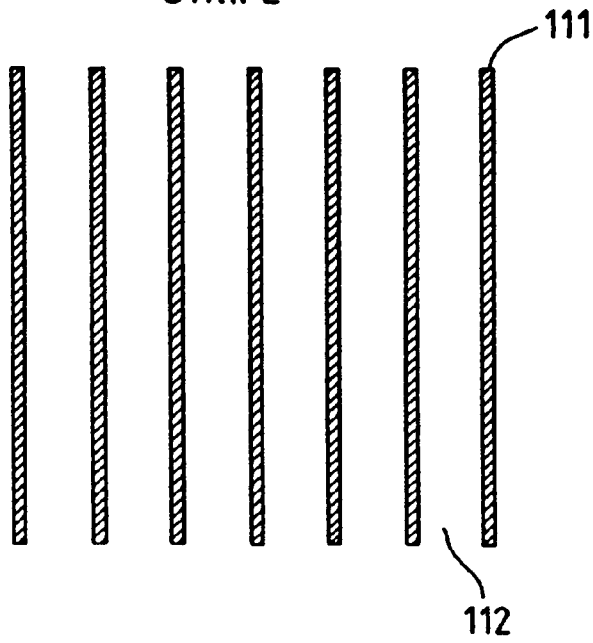
FIGS. 11A and 11B show two alternative fluorescent films that can be used for the purpose of the invention.
Figure 11B:
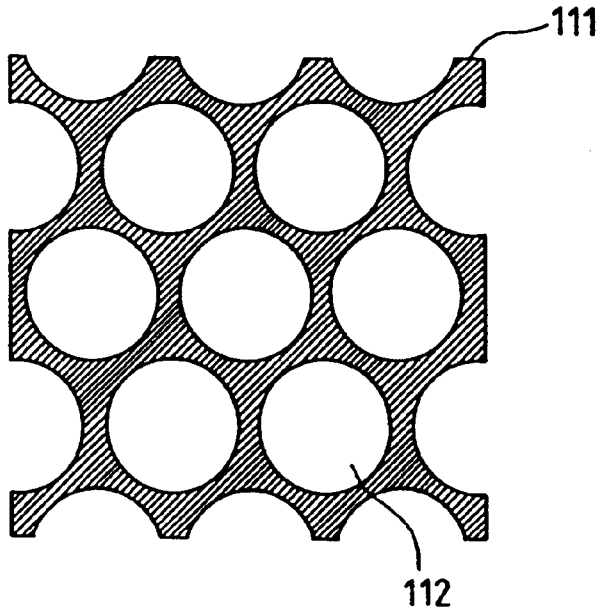
Figure 12:
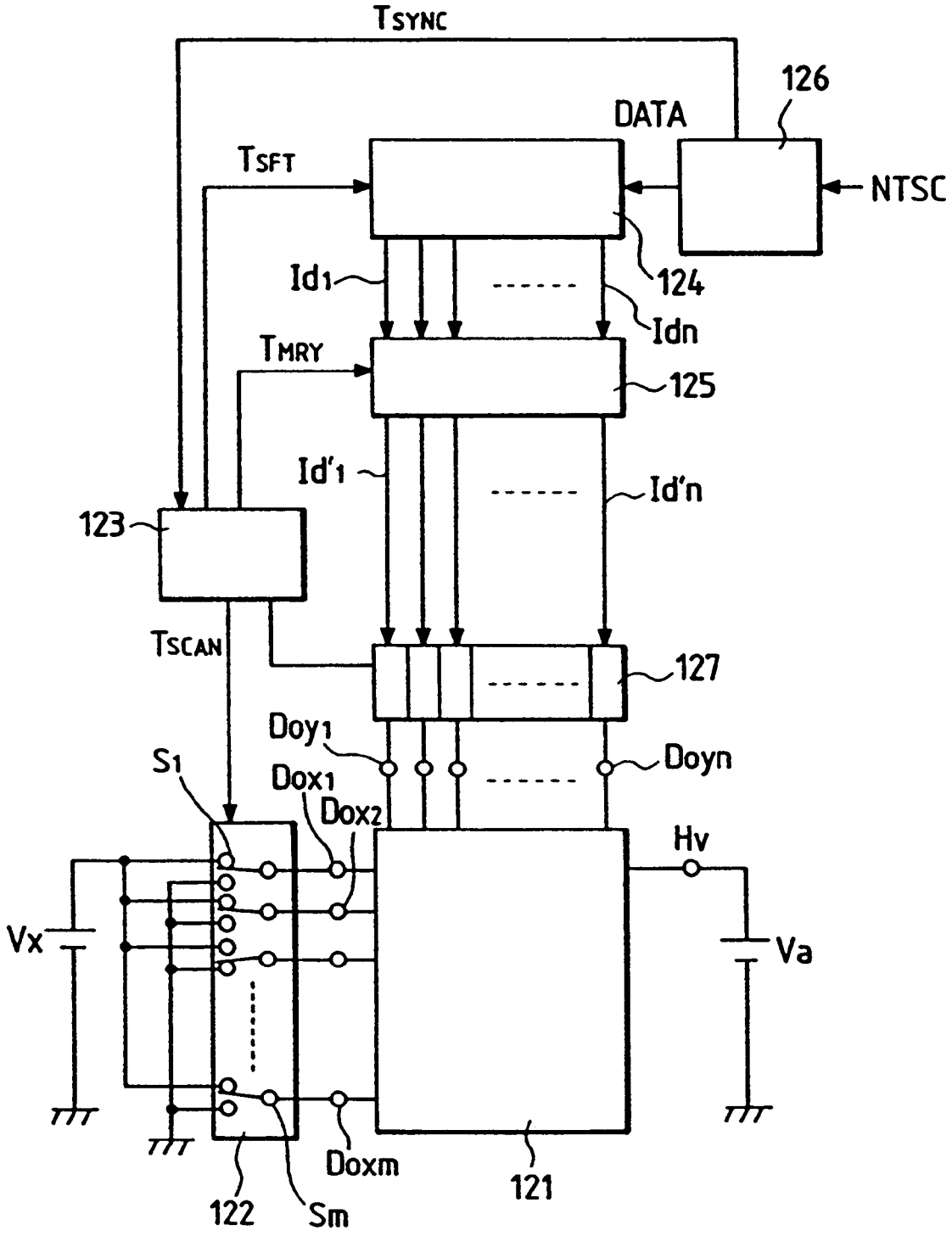
FIG. 12 is a block diagram of the drive circuit of an image-forming apparatus according to the invention adapted for the NTSC system.

FIG. 10 illustrates the basic configuration of the display panel of the image-forming apparatus and FIGS. 11A and 11B show two alternative fluorescent films that can be used for the purpose of the invention, while FIG. 12 is a block diagram of the drive circuit of the image-forming apparatus which is adapted for the NTSC system.

Referring firstly to FIG. 10, the apparatus comprises an electron source substrate 91 of the above described type, a rear plate 101 rigidly holding the electron source substrate 91, a face plate 106 produced by laying a fluorescent film 104 and a metal back 105 on the inner surface of a glass substrate 103 and a support frame 102. An envelope 108 is formed for the apparatus as frit glass is applied to said rear plate 101, said support frame 102 and said face plate 106, which are subsequently baked to 400 to 500° C. in the atmosphere or in nitrogen and bonded together to a hermetically sealed condition.

In FIG. 10, reference numeral 94 denotes the electron-emitting region of each electron-emitting device as illustrated in FIG. 9 and reference numerals 92 and 93 respectively denotes the X-directional wiring and the Y-directional wiring connected to the respective device electrodes of each electron-emitting device.

While the envelope 108 is formed of the face plate 106, the support frame 102 and the rear plate 101 in the above description, the rear plate 101 may be omitted if the substrate 91 is strong enough by itself because the rear plate 101 is provided mainly for reinforcement. If such is the case, an independent rear plate 101 may not be required and the substrate 91 may be directly bonded to the support frame 102 so that the envelope 108 is constituted of a face plate 106, a support frame 102 and a substrate 101. The overall strength against the atmospheric pressure of the envelope 108 may be increased by arranging a number of support members called spacers (not shown) between the face plate 106 and the rear plate 101.

FIGS. 11A and 11B schematically illustrate two possible arrangements of fluorescent bodies to form a fluorescent film 104. While the fluorescent film 104 comprises only fluorescent bodies if the display panel is used for showing black and white pictures, it needs to comprise for displaying color pictures black conductive members 111 and fluorescent bodies 112, of which the former are referred to as black stripes or members of a black matrix depending on the arrangement of the fluorescent bodies. Black stripes or members of a black matrix are arranged for a color display panel so that the fluorescent bodies 112 of three different primary colors are made less discriminable and the adverse effect of reducing the contrast of displayed images of external light is weakened by blackening the surrounding areas. While carbon black is normally used as a principal ingredient of the black stripes, other conductive material having low light transmissivity and reflectivity may alternatively be used.

A precipitation or printing technique may suitably be used for applying a fluorescent material on the glass substrate 103 regardless of black and white or color display.

An ordinary metal back 105 is arranged on the inner surface of the fluorescent film 104. The metal back 105 is provided in order to enhance the luminance of the display panel by causing the rays of light emitted from the fluorescent bodies and directed to the inside of the envelope to turn back toward the face plate 106, to use it as an electrode for applying an accelerating voltage to electron beams and to protect the fluorescent bodies against damages that may be caused when negative ions generated inside the envelope collide with them. It is prepared by smoothing the inner surface of the fluorescent film 104 (in an operation normally called "filming") and forming an A1 film thereon by vacuum deposition after forming the fluorescent film 104.

A transparent electrode (not shown) may be formed on the face plate 106 facing the outer surface of the fluorescent film 104 in order to raise the conductivity of the fluorescent film 104.

Care should be taken to accurately align each set of color fluorescent bodies and an electron-emitting device, if a color display is involved, before the above listed components of the enclosure are bonded together.

The envelope 108 is then evacuated by way of an exhaust pipe (not shown) to a degree of vacuum of approximately $10^{-7}$ torr and hermetically sealed. A getter operation may be carried out after sealing the envelope 108 in order to maintain that degree of vacuum in it. A getter operation is an operation of heating a getter (not shown) arranged at a given location in the envelope 108 immediately before or after sealing the envelope 108 by resistance heating or high frequency heating to produce a vapor deposition film. A getter normally contains Ba as a principle ingredient and the formed vapor deposition film can typically maintain the inside of the enclosure to a degree of $1\times10^{-5}$ to $10^{-7}$ torr by its adsorption effect.

FIG. 12 shows a block diagram of the drive circuit for driving the display panel of an image-forming apparatus comprising an electron source having a simple matrix arrangement as described above, said apparatus being designed for image display operation using NTSC television signals.

In FIG. 12, reference numeral 121 denotes the display panel. The circuit further comprises a scan circuit 122, a control circuit 123, a shift register 124, a line memory 125, a synchronizing signal separation circuit 126, a modulation signal generator 127 and a pair of DC voltage sources Vx and Va.

Each component of the apparatus operates in a manner as described below. The display panel 121 is connected to external circuits via terminals Dox1 through Doxm, Doy1 through Doym and a high voltage terminal Hv, of which terminals Dox1 through Doxm are designed to receive scan signals for sequentially driving on a one-by-one basis the rows (of a total of N devices) of surface conduction electron-emitting devices arranged in the form of a matrix having M rows and N columns in the electron source. On the other hand, terminals Doy1 through Doym are designed to receive a modulation signal for controlling the output electron beam of each of the surface-conduction type electron-emitting devices of a row selected by a scan signal. High voltage terminal Hv is fed by the DC voltage source Va with a DC voltage of a level typically around 10 V, which is sufficiently high to energize the fluorescent bodies of the selected surface-conduction type electron-emitting devices.

The scan circuit 122 operates in a manner as follows.

The scan circuit 122 comprises M switching devices (which are schematically shown and denoted by symbols S1 and Sm in FIG. 12), each of which takes either the output voltage of the DC voltage source Vx or 0V (the ground potential) and comes to be connected with one of the terminals Dox1 through Doxm of the display panel 121. Each of the switching devices S1 through Sm operates in accordance with control signal Tscan fed from the control circuit 123 and can be easily prepared by combining transistors such as FETs.

The DC voltage source Vx of this mode of carrying out the invention is designed to output a constant voltage taking the characteristic properties (including the threshold voltage for electron emission) of the surface conduction electron-emitting devices into consideration.

The control circuit 123 coordinates the operations of related components so that images may be appropriately displayed in accordance with externally fed picture signals. It generates control signals Tscan, Tsft and Tmry for the related components in response to synchronizing signal Tsync fed from the synchronizing signal separation circuit 126. These control signals will be described later in greater detail hereinafter.

The synchronizing signal separation circuit 126 separates the synchronizing signal component and the luminance signal component from an externally fed NTSC television signal and can be easily realized using a popularly known frequency separation (filter) circuit. Although a synchronizing signal extracted from a television signal by the synchronizing signal separation circuit 126 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 124, is designed as DATA signal.

The shift register 124 carries out for each line a serial/parallel conversion on DATA signals that are serially fed on a time series basis in accordance with control signal Tsft fed from the control circuit 123. In other words, a control signal Tsft operates as a shift clock for the shift register 124. A set of data for a line that have undergone a serial/parallel conversion (and correspond to a set of drive data for N electron-emitting devices) are sent out of the shift register 124 as n parallel signals Id1 through Idn.

The line memory 125 is a memory for storing a set of data for a line, which are signals Id1 through Idn, for a required period of time according to control signal Tmry coming from the control circuit 123. The stored data are sent out as I'd1 through I'dn and fed to modulation signal generator 127.

The modulation signal generator 127 is in fact a signal source that appropriately drives and modulates the operation of each of the surface-conduction type electron-emitting devices according to each of the picture data I'd1 through D'dn and output signals of this device are fed to the surface-conduction type electron-emitting devices in the display panel 121 via terminals Doy1 through Doym.

As described above, an electron-emitting devices according to the present invention is characterized by the following features in terms of emission current Ie. There exists a clear threshold voltage Vth and the electron-emitting devices emit substantially no electron when a voltage that falls short of the threshold voltage Vth is applied thereto.

On the other hand, when the voltage applied to the surface conduction electron-emitting devices exceeds the threshold level, the rate of electron emission of the surface conduction electron-emitting devices varies as a function of the voltage applied thereto. While the threshold voltage Vth for electron emission and the rate of electron emission relative to the applied voltage may vary depending on the materials, the configuration and the manufacturing method of electron-emitting devices, the following statement always holds true.

When a pulse-shaped voltage is applied to an electron-emitting device according to the invention, it emits substantially no electron if the applied voltage is found below the threshold voltage,for electron emission but starts emitting electrons once the applied voltage exceeds the threshold level. Thus, firstly the rate of electron beam emission of the device can be controlled by appropriately changing the wave height, or amplitude Vm, of the pulse-shaped voltage. Secondly, the total electric charge of the electron beams being emitted by the device can be controlled by appropriately changing the pulse width Pw of the applied voltage.

Therefore, the electron-emitting device can be modulated as a function of input signals either by voltage modulation or by pulse width modulation. The modulation signal generator 127 to be used for voltage modulation may comprise a circuit that generates a voltage pulse having a constant width and a variable wave height that varies as a function of input data.

On the other hand, the modulation signal generator 127 to be used for pulse width modulation comprises a circuit for generating a voltage pulse having a constant wave height and a variable pulse width that varies as a function of input data.

As a result of coordinated operation of the above described components, television images are displayed on the display panel 121 of the apparatus. Although it is not particularly mentioned above that the shift register 124 and the line memory 125 may be either of digital or of analog signal type so long as serial/parallel conversions and storage of video signals are conducted at a given rate.

If digital signal type devices are used, output signal DATA of the synchronizing signal separation circuit 126 needs to be digitized. However, such conversion can be easily carried out by arranging an A/D converter at the output of the synchronizing signal separation circuit 126. In connection with this, it should be noted that the circuit to be used for the modulation signal generator 127 may have to be slightly modified depending on if digital or analog signals are produced by the line memory 125.

More specifically, when digital signals are used for voltage modulation, the modulation signal generator 127 may suitably comprise a D/A conversion circuit, to which an amplifying circuit may appropriately be added if necessary. For pulse width modulation, the modulation signal generator 127 may use a circuit typically comprising in combination a high speed oscillator, a counter for counting the number of waves produced by the oscillator and a comparator for comparing the output value of said counter and that of said memory. If necessary, an amplifier may additionally be used to amplify the voltage of the modulation signal produced by the comparator and modulated for pulse width to the level of the drive voltage of the surface conduction electron-emitting device.

When, on the other hand, analog signals are used for voltage modulation, the modulation signal generator 127 may suitably comprise an amplifying circuit involving an operational amplifier and a level shift circuit may appropriately be added thereto if necessary. For pulse width modulation, the modulation signal generator 127 may comprise a voltage control type oscillation circuit (VCO), to which an amplifier may be added to amplify the voltage of the modulation signal to the level of the drive voltage of the surface conduction electron-emitting device.

With an image-forming apparatus according to the invention and having a configuration as described above, the electron-emitting devices are selectively caused to emit electrons by applying a device voltage to them via the terminals Dox1 through Doxm and Doy1 through Doyn that are external to the envelope while applying a high voltage to the metal back 105 or the transparent electrode (not shown) via the high voltage terminal Hv in order to accelerate the emitted electron beams until they collide with an energize the fluorescent film 104 so that the latter emits light and display images.

While the configuration of an image-forming apparatus according to the invention is schematically described above, the materials and details of the components are not limited to the above description and may be modified appropriately depending on the application of the apparatus. While the present invention is described above in terms of television image display using the NTSC television signal system, the TV signal system to be used is not limited to a particular one and any other system such as PAL or SECAM may feasibly be used with it. An image-forming apparatus according to the invention is particularly suited for TV signals involving a larger number of scanning lines typically of a high definition TV system such as the MUSE system because it can be used for a large display panel comprising a large number of scanning lines.

Now, an electron source having a ladder-like arrangement and an image-forming apparatus comprising such an electron source will be described for basic configuration by referring to FIGS. 13A, 13B and 14.

Figure 13A:
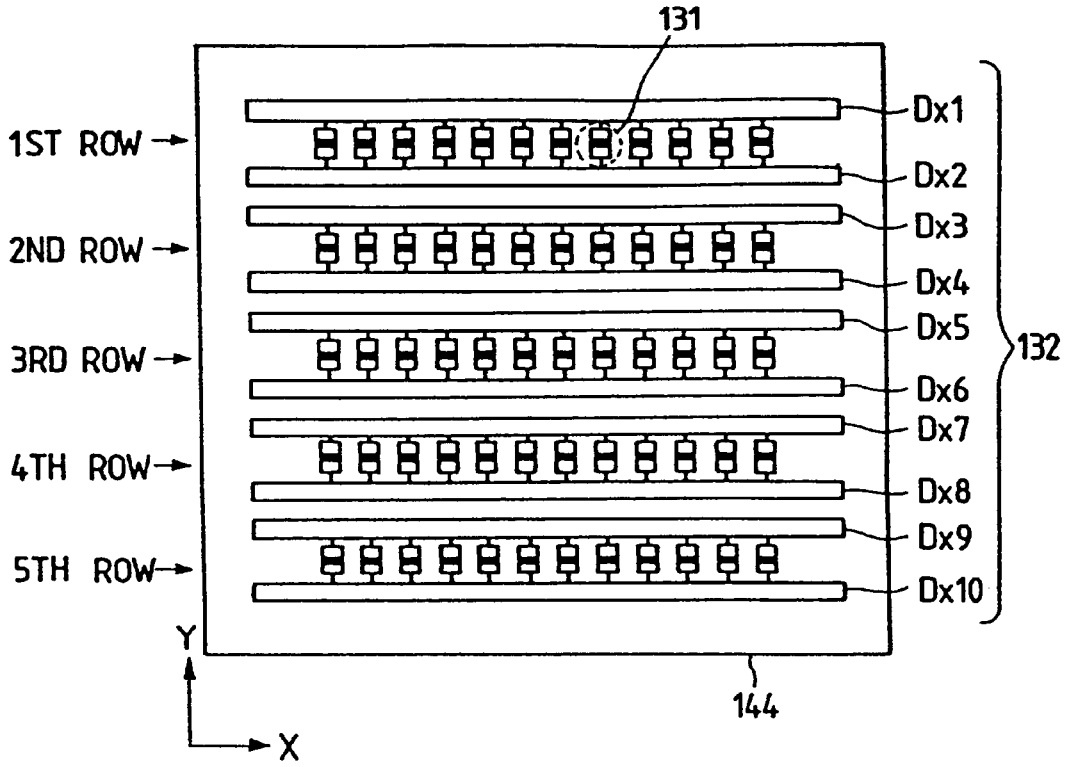
FIGS. 13A and 13B schematically show two alternative ladder-like arrangements of electron-emitting devices for an electron source according to the invention.
Figure 13B:
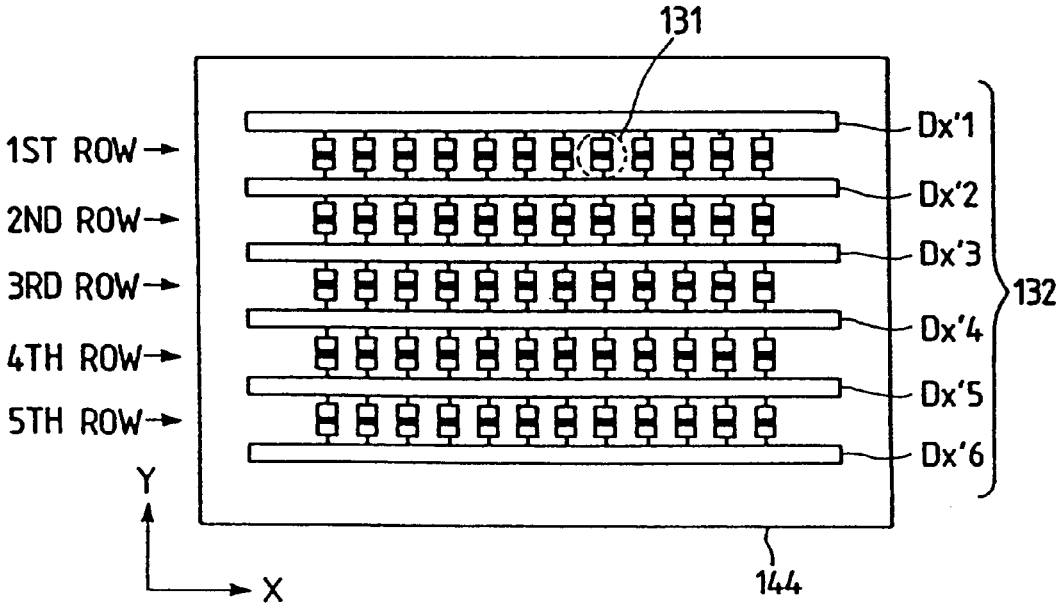

Referring to FIGS. 13A and 13B showing two alternative ladder-like arrangements of electron-emitting devices for an electron source, the electron source comprises an electron source substrate 144, a number of electron-emitting devices 131 and paired common wirings Dx1 through Dx10 collectively denoted by 132 for wiring the electron-emitting devices. The electron-emitting devices 131 are arranged in a plurality of parallel rows running along the 'X-direction on the substrate 144 (hereinafter referred to device rows).

With such an arrangement, the device rows of the electron source can be independently driven by applying a drive voltage to the common wiring pairs (Dx1–Dx2, Dx3–Dx4, Dx5–DX6, Dx7–Dx8, Dx9–Dx10). In other words, a voltage higher than the threshold voltage is applied to one or more than one device rows that have to emit electron beams whereas a voltage lower than the threshold level is applied to the remaining device rows that are not expected to emit electron beams. Alternatively, a single common wiring may be used for any two adjacent device rows (and common wirings Dx2 and Dx3, Dx4 and Dx5, Dx6 and Dx7 and Dx8 and Dx9 may be replaced by respective single common wirings).

Figure 14:
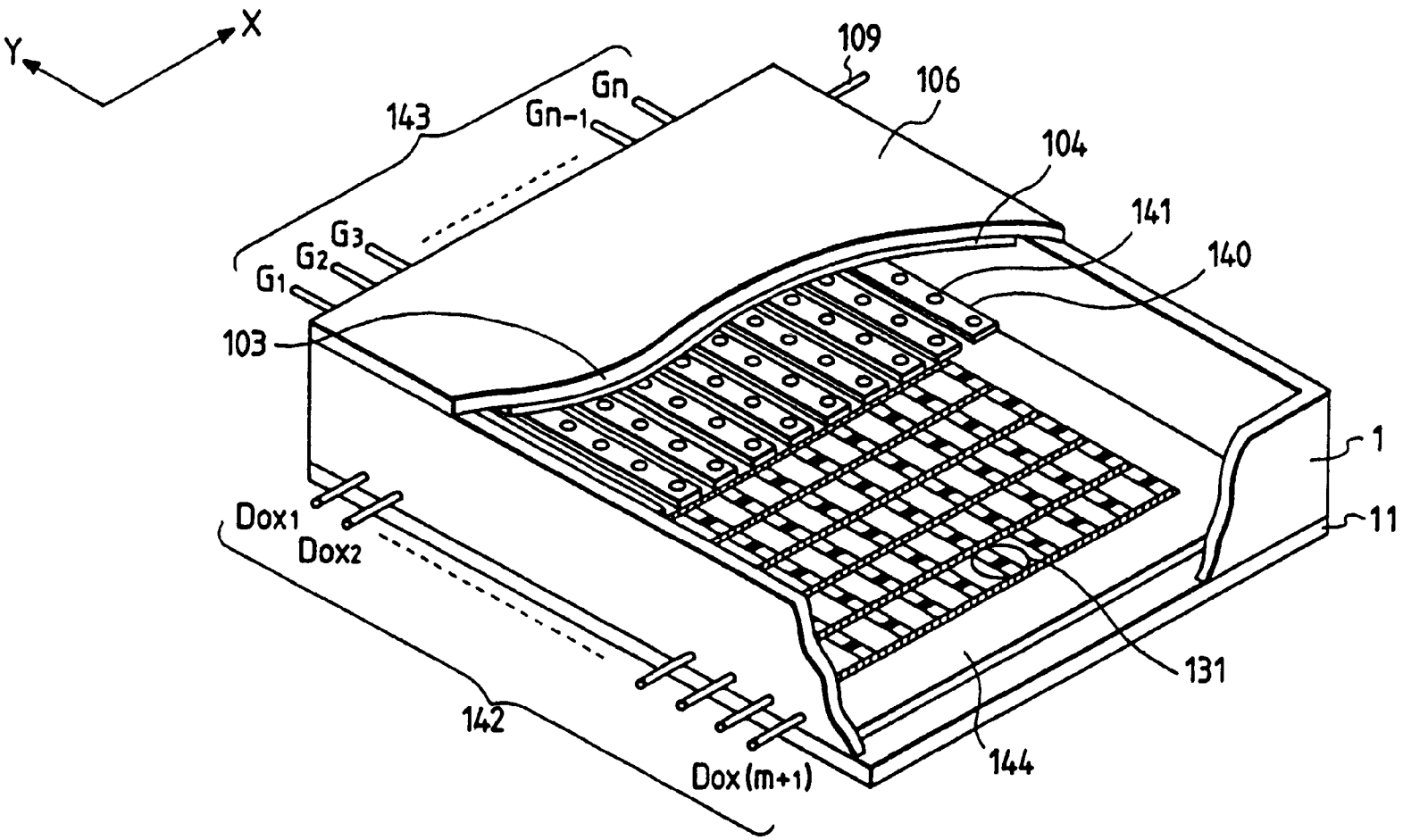
FIG. 14 is a schematic perspective view of the display panel of an image-forming apparatus according to the invention incorporating an electron source having a ladder-like arrangement of electron-emitting devices.

FIG. 14 is a schematic perspective view of the display panel of an image-forming apparatus according to the invention incorporating an electron source having a ladder-like arrangement of electron-emitting devices. In FIG. 14, the display panel comprises grid electrodes 140, each provided with a number of through bores 141 for allowing electrons to pass therethrough, external terminals Dox1, Dox2, . . . , Doxm collectively denoted by 142, external terminals G1, G2, . . . , Gn collectively denoted by 143 and connected to the respective grid electrodes and an electron source substrate 144 as shown in FIG. 13B. Note that the same components are respectively denoted by the same reference symbols in FIGS. 13A, 13B and 14.

The display panel of FIG. 14 remarkably differs from that of the image-forming apparatus of FIG. 10 having a simple matrix arrangement in that it additionally comprises grid electrodes 140 arranged between the electron source substrate 144 and the face plate 106.

As described above, strip-shaped grid electrodes 140 are arranged between the substrate 144 and the face plate 106 in FIG. 14 and rectangularly relative to the devices rows arranged in a ladder-like manner in such a way that they can modulate electron beams emitted from the surface conduction electron-emitting devices of the electron source. The grid electrodes are provided with circular through bores 141 that are as many as the electron-emitting devices to make one-to-one correspondence. However, the profile and the location of the grid electrodes are not limited to those of FIG. 14 and may be modified appropriately so long as they are arranged near or around the electron-emitting devices. Likewise, the through bores 141 may be replaced by meshes or the like.

The external terminals 142 and the external terminals for the grids 143 are electrically connected to a control circuit (not shown).

An image-forming apparatus having a configuration as described above can control the fluorescent film for electron beam irradiation by simultaneously applying modulating signals to the columns of grid electrodes for a single line of an image in synchronism with driving the electron-emitting devices on a row by row basis so that the image can be displayed on a line by line basis.

Thus, a display apparatus according to the invention and having a configuration as described above can have a wide variety of industrial and commercial applications because it can operate as a display apparatus for television broadcasting, as a terminal apparatus for video teleconferencing and as an optical printer if it is combined with a photo-sensing drum.

EXAMPLES

Now, the present invention will be described in greater detail by way of examples.

Example 1

The method of manufacturing electron-emitting devices will be described below in terms of an experiment conducted on specimens, referring to FIGS. 7A and 7B and FIGS. 3A to 3C.

Step a:

After thoroughly cleansing a soda lime glass plate a silicon oxide film was formed thereon to a thickness of 0.5 microns by sputtering to produce a substrate 1, on which a pattern of photoresist (RD-2000N-41: available from Hitachi Chemical Co., Ltd.) was formed for a pair of device electrodes and a gap separating the electrodes and then Ti and Ni were sequentially deposited thereon respectively to thicknesses of 50 Å and 1,000 Å by vacuum deposition. The photoresist pattern was dissolved in an organic solvent and the Ni/Ti deposit film was treated by using a lift-off technique to produce a pair of device electrodes 5 and 6 having a width W of 300 microns and separated from each other by a distance L of 20 microns (FIG. 3A).

Step b:

A mask having opening for the gap L separating the device electrodes and its vicinity was used to form a Cr film to a film thickness of 1,000 Å by vacuum deposition, which was then subjected to a patterning operation. Thereafter, organic Pd (ccp4230: available from Okuno Pharmaceutical Co., Ltd.) was applied to the Cr film by means of a spinner, while rotating the film, and baked at 300° C. for 10 minutes to produce an electroconductive film for forming an electron-emitting region, which was made of fine particles containing $PdO_x$ as a principal ingredient and had a film thickness of 100 angstroms and an electric resistance per unit area of $5\times10^4$ Ω/□.

Note that the term "a fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is that of recognizable fine particles arranged in any of the above described states.

Figure 3B:
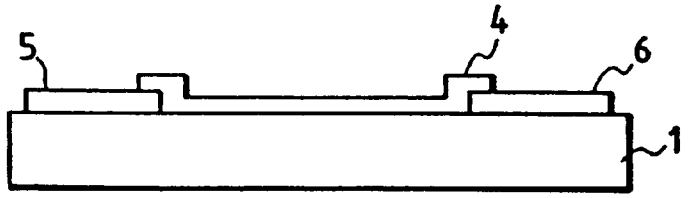
Figure 3C:
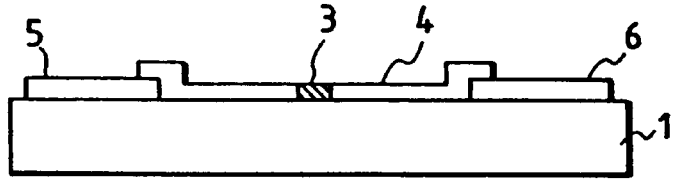

Step c:

The Cr film and the baked electroconductive film for forming an electron-emitting region were etched by using an acidic etchant to produce an electro-conductive film 4 having a desired pattern (FIG. 3B).

Now, a device having a pair of device electrodes and an electroconductive film disposed between the electrodes on the substrate was prepared.

Step d:

Then, the substrate of the device was set in position in a gauging system as illustrated in FIG. 4 and the inside of the vacuum chamber of the system was evacuated by means of an exhaust pump to a degree of vacuum of $1\times10^{-6}$ torr. Subsequently, a voltage Vf was applied for 60 seconds from the power source 31 to the device electrodes 5, 6 to electrically energize the device (electric forming process) and produce a locally deformed (fissured) section (electron emitting region) 3 in the electro-conductive film (FIG. 3C).

FIG. 5B shows the voltage waveform used for the electric forming process.

In FIG. 5B, T1 and T2 respectively denote the pulse width and the pulse interval of the applied pulse voltage, which were respectively 1 millisecond and 10 milliseconds for this example. The wave height (the peak voltage for the forming operation) of the applied pulse voltage was increased stepwise with steps of 0.1V.

It was found that fine particles containing palladium oxide as a principal ingredient were dispersed in the electron emitting region 3 of the device produced by following the above steps, the average diameter of the particles being 30 angstroms.

Step e:

Subsequently, the electro-conductive film 4 of the device that had undergone an electric forming operation was subjected to a chemical reduction process.

In this process, the device and a monitoring device that had not been processed for electric forming (but had undergone the steps of through c above) were arranged in an apparatus having a configuration as shown in FIG. 4 and then heated to 130° C. to 200° C. for approximately 10 hours, while keeping the inside of the apparatus to a degree of vacuum of $1\times10^{-6}$ torr.

After the chemical reduction process, it was found that the electro-conductive film containing PdOx as a principal ingredient of the monitoring device without an electric forming process had been chemically reduced to become a film of fine particles of Pd metal having an electric resistance per unit area of $5\times10^{-2}$ Ω/□ or a value smaller than the resistance before the chemical reduction by two digits.

In an attempt to see the properties of the electron-emitting device prepared throughout the preceding steps, it was observed for electron-emitting performance, using a measuring system as illustrated in FIG. 4. In the above observation, the distance H between the anode 34 and the electron-emitting device was 4 mm and the potential of the anode 34 was 1 kV, while the degree of vacuum in the vacuum chamber of the system was held to $1\times10^{-6}$ torr throughout the gauging operation.

A device voltage was applied between the device electrodes 5, 6 of the device to see the device current If and the emission current Ie under that condition. FIG. 6 shows the current-voltage relationships obtained as a result of the observation.

An emission current Ie began to flow through the device immediately when the device voltage (Vf) became as high as 8V and a device current If of 3.0 mA and an emission current of 1.5 microA were observed when the device voltage rose to 14V to provide an electron emission efficiency $\eta$=Ie/If× 100(%) of 0.05%.

When the device was observed before the chemical reduction process, the film of PdO fine particles (electro-conductive film) of the device showed an electric resistance of 3.5 kΩ and the fissured area had an electric resistance of 4.7 kΩ. After the chemical reduction process, it was found that the electric resistance of the film of PdO fine particles of the electron-emitting device was as low as 35 Ω, which was negligible when compared with that of the fissured area.

In other words, for an electron-emitting device after a chemical reduction process according to the invention to obtain the same electron emission rate as a device before the process having required a device voltage of 24.6V, the device after the process required a power consumption rate of only 42 milliW whereas it was 73.8 milliW for the device before the process, i.e. the former being 57% of the latter, thus proving a significant saving of power.

Example 2

This example relates to an electron source comprising a plurality of electron-emitting devices produced by the method of Example 1 and an image-forming apparatus incorporating such an electron source.

Figure 15:
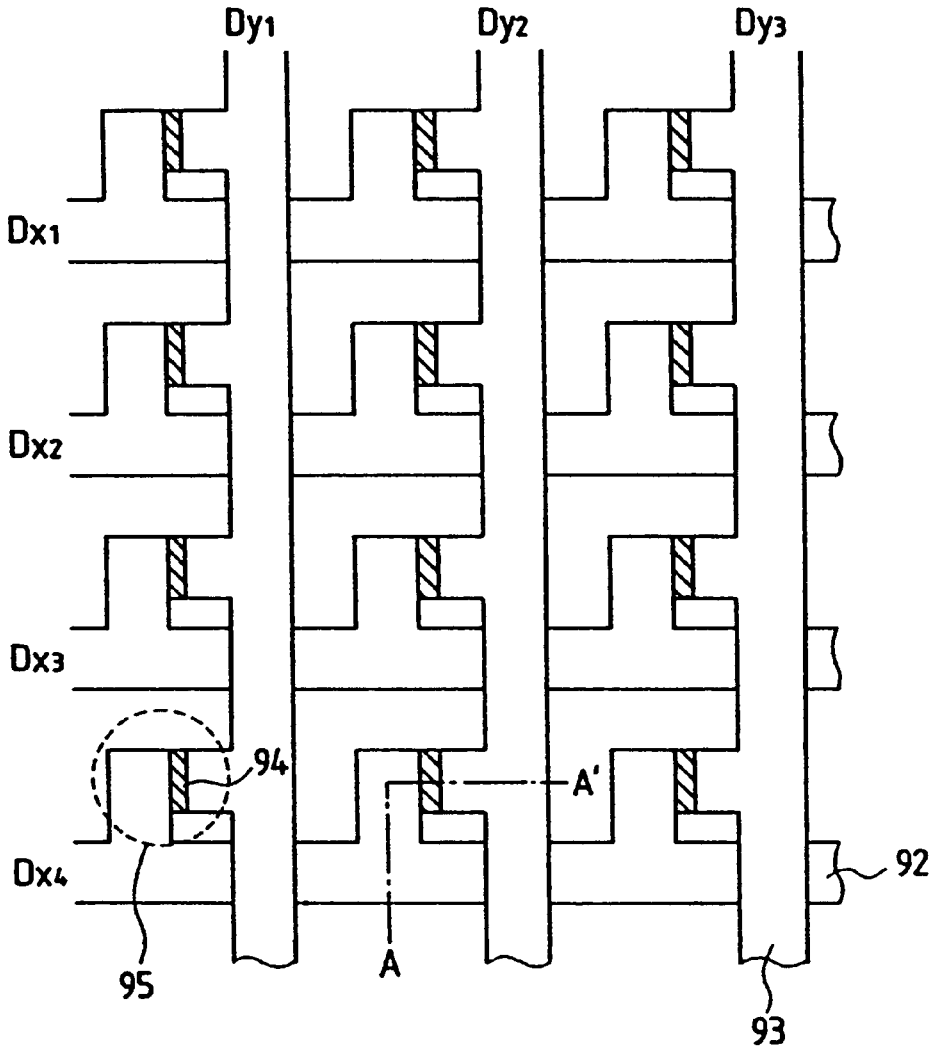
FIG. 15 is an enlarged schematic partial view of an electron source having a simple matrix arrangement of electron-emitting devices.
Figure 16:
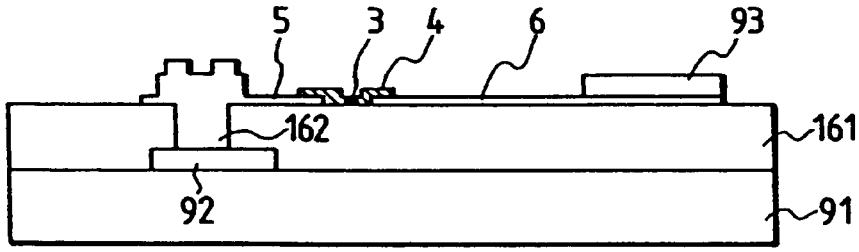
FIG. 16 is a schematic sectional view of an electron-emitting device of the electron source of FIG. 15 taken along line A–A'.

FIG. 15 shows a schematic partial plan view of the electron source and FIG. 16 shows a schematic partial sectional view taken along line A–A' of FIG. 15, while FIGS. 17A to 17F and 18G to 18I illustrate schematic partial sectional views of the electron source shown in different manufacturing steps. Note that same or similar components are respectively designated by same reference symbols throughout FIGS. 15 through 18I.

91 denotes a substrate and 92 and 93 respectively denote X- and Y-directional wirings (which may be called lower and upper wirings respectively) that correspond to Dxm and Dyn in FIG. 9. Otherwise, the electron source comprises electron-emitting devices, each having an electro-conductive film 4 and a pair of device electrodes 5 and 6, an interlayer insulation layer 161 and a number of contact holes, each of which is used to connect a device electrode 5 with a related lower wiring 92.

Now, the steps of manufacturing an electron source and an image-forming apparatus incorporating such as electron source used in this example will be described in detail.

Figure 17A:
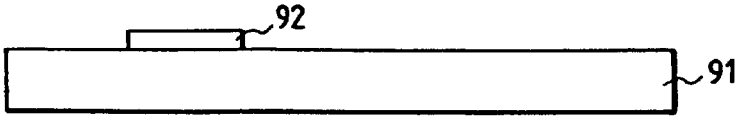
FIGS. 17A to 17F and 18G to 18I show schematic sectional views of an electron-emitting device to be used for an electron source having a simple matrix arrangement, showing different manufacturing steps.

Step a:

After thoroughly cleansing a soda lime glass plate a silicon oxide film was formed thereon to a thickness of 0.5 microns by sputtering to produce a substrate 91, on which Cr and Au were sequentially laid to thicknesses of 50 angstroms and 6,000 angstroms respectively and then a photoresist (AZ1370: available from Hoechst Corporation) was formed thereon by means of a spinner, while rotating the film, and baked. Thereafter, a photo-mask image was exposed to light and developed to produce a resist pattern for the lower wirings 92 and then the deposited Au/Cr film was wet-etched to produce lower wirings 92 having a desired profile (FIG. 17A).

Figure 17B:
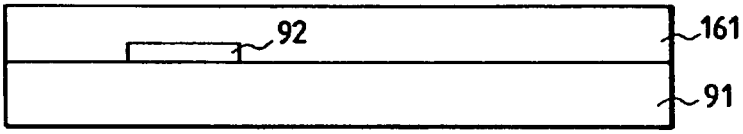

Step b:

A silicon oxide film was formed as an interlayer insulation layer 161 to a thickness of 1.0 micron by RF sputtering (FIG. 17B).

Figure 17C:
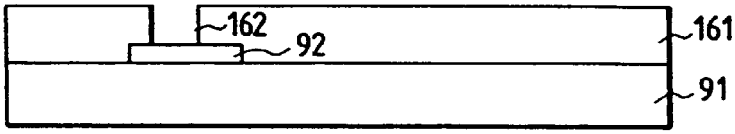

Step c:

A photoresist pattern was prepared for producing contact holes 162 in the silicon oxide film deposited in Step b, which contact holes 162 were then actually formed by etching the interlayer insulation layer 161, using the photoresist pattern for a mask (FIG. 17C).

RIE (Reactive Ion Etching) using $CF_4$ and $H_2$ gas was employed for the etching operation.

Figure 17D:
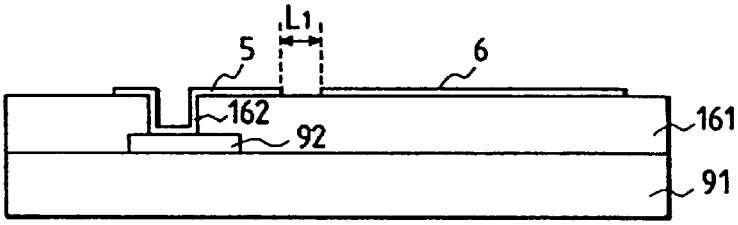

Step d:

Thereafter, a pattern of photoresist (RD-2000N-41: available from Hitachi Chemical Co., Ltd.) was formed for pairs of device electrodes 5 and 6 and gaps L1 separating the respective pairs of electrodes and then Ti and Ni were sequentially deposited thereon respectively to thicknesses of 50 Å and 1,000 Å by vacuum deposition. The photoresist pattern was dissolved by an organic solvent and the Ni/Ti deposit film was treated by using a lift-off technique to produce pairs of device electrodes 5 and 6, each pair having a width of 300 microns and separated from each other by a distance L1 of 20 microns (FIG. 17D).

Figure 17E:
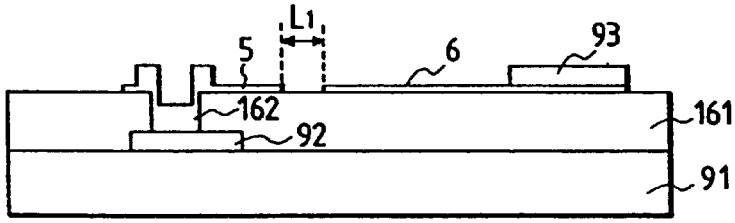

Step e:

After forming a photoresist pattern on the device electrodes 5, 6 for upper wirings 93, Ti and Au were sequentially deposited by vacuum deposition to respective thicknesses of 50 angstroms and 5,000 angstroms and then unnecessary areas were removed by means of a lift-off technique to produce upper wirings 93 having a desired profile (FIG. 17E).

Step f:

A mask was prepared for the electro-conductive films 2 of the devices.

Figure 17F:
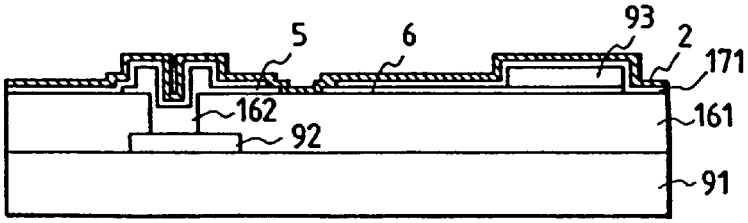

The mask had an opening for the gap L1 separating the device electrodes and its vicinity of each device. The mask was used to form a Cr film 171 to a film thickness of 1,000 Å by vacuum deposition, which was then subjected to a patterning operation. Thereafter, organic Pd (ccp4230: available from Okuno Pharmaceutical Co., Ltd.) was applied to the Cr film by means of a spinner, while rotating the film, and baked at 300° C. for 10 minutes (FIG. 17F).

The formed electro-conductive films 2 were made of fine particles containing $PdO_x$ as a principal ingredient and had a film thickness of 100 angstroms and an electric resistance per unit area of $5\times10^4$ Ω/□.

Note that the term "a fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is that of recognizable fine particles arranged in any of the above described states.

Figure 18G:
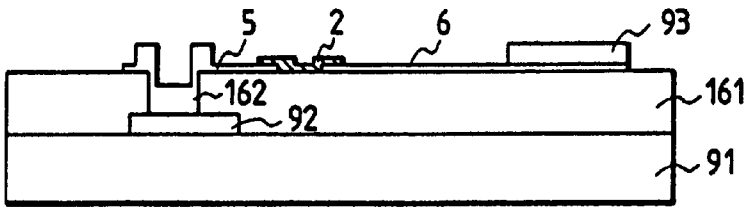

Step g:

The Cr film 171 and the baked electro-conductive film 2 were etched by using an acidic etchant to produce a desired pattern (FIG. 18G)

Figure 18H:
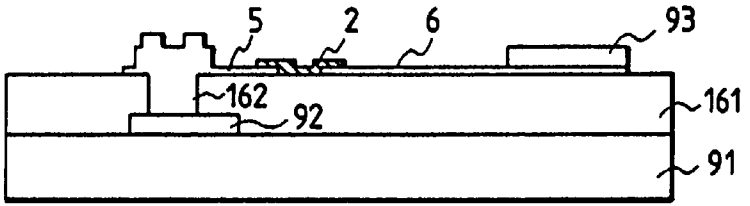

Step h:

Then, a pattern for applying photoresist to the entire surface area except the contact holes 162 was prepared and Ti and Au were sequentially deposited by vacuum deposition to respective thicknesses of 50 angstroms and 5,000 angstroms. Any unnecessary areas were removed by means of a lift-off technique to consequently bury the contact holes 162 (FIG. 18H).

Now, lower wirings 92, an interlayer insulation layer 161, upper wirings 93, and devices comprising pairs of device electrodes 5 and 6 and electro-conductive films 2 were produced on the substrate 91.

Then, an electron source comprising the above electron source substrate and an image-forming apparatus incorporating such an electron source were prepared. This will be described below by referring to FIGS. 10, 11A and 11B.

The substrate 91 carrying thereon a large number of devices prepared according to the above described process was rigidly fitted to a rear plate 101 and thereafter a face plate 106 (prepared by forming a fluorescent film 104 and a metal back 105 on a glass substrate 103) was arranged 5 mm above the substrate 91 by interposing a support frame 102 therebetween. Frit glass was applied to junction areas of the face plate 106, the support frame 102 and the rear plate 101, which were then baked at 400° C. for 15 minutes in the atmosphere and bonded together to a hermetically sealed condition (FIG. 10). The substrate 91 was also firmly bonded to the rear plate 101 by means of frit glass.

In FIG. 10, reference numerals 92 and 93 respectively denote X- and Y-directional wirings. While the fluorescent film 104 may be solely made of fluorescent bodies if the image-forming apparatus is for black and white pictures, firstly black stripes were arranged and then the gaps separating the black stripes were filled with respective fluorescent bodies for primary colors to produce a fluorescent film 104 for this example (FIG. 11A). The black stripes were made of a popular material containing graphite as a principal ingredient. The fluorescent bodies were applied to the glass substrate 103 by using a slurry method.

A metal back 105 is normally arranged on the inner surface of the fluorescent film 104. In this example, a metal back was prepared by producing an Al film by vacuum deposition on the inner surface of the fluorescent film 104 that had been smoothed in a so-called filming process. The face plate 106 may be additionally provided with transparent electrodes (not shown) arranged close to the outer surface of the fluorescent film 104 in order to improve the conductivity of the fluorescent film 104, no such electrodes were used in this example because the metal back proved to be sufficiently conductive.

The fluorescent bodies were carefully aligned with the respective devices before the above described bonding operation.

The prepared glass container was then evacuated by means of an exhaust pipe (not shown) and an exhaust pump to achieve a sufficient degree of vacuum inside the container. Thereafter, the electro-conductive film 2 of each of the devices arranged on the substrate 91 was subjected to an electric forming operation, where a voltage was applied to the device electrodes 5, 6 of the devices by way of the external terminals Dox1 through Doxm and Doy1 through Doyn to produce an electron-emitting region 3 in each electro-conductive film 2.

The voltage used in the forming operation had a waveform same as the one shown in FIG. 5B. Referring to FIG. 5B, T1 and T2 were respectively 1 milliseconds and 10 milliseconds and the electric forming operation was carried out in vacuum of a degree of approximately $1\times10^{-6}$ torr. The wave height (the peak voltage for the forming operation) of the applied pulse voltage was increased stepwise with steps of 0.1 V.

A monitoring device was also prepared without subjecting them to an electric forming operation so that it may be used to monitor the electric resistance of each device during a subsequent chemical reduction process, which will be described hereinafter.

Dispersed fine particles containing palladium oxide as a principal ingredient were observed in the electron-emitting regions 3 of the electron-emitting devices that had been produced in the above process. The fine particles had an average particle diameter of 30 angstroms.

Figure 18I:
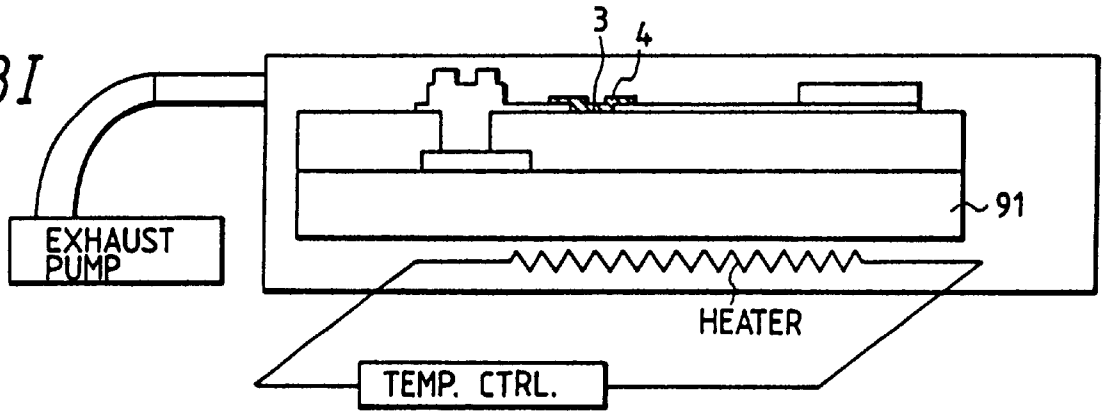

Step i:

Subsequently, the electro-conductive film 4 including an electron-emitting region each of the electron-emitting device was subjected to a chemical reduction process (FIG. 18I).

In this process, the enclosure comprising a face plate 106, a support frame 102 and a rear plate 101 was evacuated by means of an exhaust pump to a degree of vacuum of $1\times10^{-6}$ torr and then the devices were heated to 130° C. to 200° C. for approximately 10 hours in the vacuum. After the chemical reduction process, it was found that the electro-conductive film 2 (film of PdO fine particles) of the control device without an electric forming process had been chemically reduced to become a film of fine particles of Pd metal having an electric resistance per unit area of $5\times10^2$ Ω/□ or a value smaller than the resistance before the chemical reduction by two digits.

Thus, the operation of preparing an electron source was completed as the devices arranged on the substrate 91 had been subjected to an electric forming operation to produce electron-emitting regions 3 and a chemical reduction process.

Thereafter, the enclosure was evacuated to a degree of vacuum of approximately of $10^{-6}$ torr and then hermetically sealed by melting and closing the exhaust pipe (not shown) by means of a gas burner.

The apparatus was subjected to a getter process using a high frequency heating technique in order to maintain the degree of vacuum in the apparatus after the sealing operation, where a getter disposed at a predetermined position (not shown) in the enclosure was heated by high frequency heating immediately before the sealing operation to form a film as a result of vapor deposition. The getter is a material containing Ba as a principal component.

The electron source having a simple matrix arrangement as described above was then used to produce an image-forming apparatus adapted for the NTSC television system. The image-forming apparatus was complete with a drive circuit as illustrated in FIG. 12 and described earlier. Pulse modulation was used for the image-forming apparatus.

The electron-emitting devices of the above image-forming apparatus were then caused to emit electrons by applying a drive voltage thereto through the external terminals Dox1 through Doxm and Doy1 through Doyn and the emitted electrons were accelerated by applying a high voltage of 10 kV to the metal back 105 via the high voltage terminal Hv so that they collides with the fluorescent film 104 until the latter was energized to emit light and produce images. As the image-forming apparatus of this example had undergone a chemical reduction process for the electro-conductive films of the electron-emitting devices in the process of manufacturing them, it has a feature of low energy consumption rate for operation.

Example 3

A chemical reduction process was carried out in a reducing atmosphere for this example.

An electron-emitting device having a configuration as illustrated in FIGS. 7A, 7B was prepared by following Steps a through e, of which Steps a through d are same as those of Example 1 above. So, only Step e will be described here.

Figure 19:
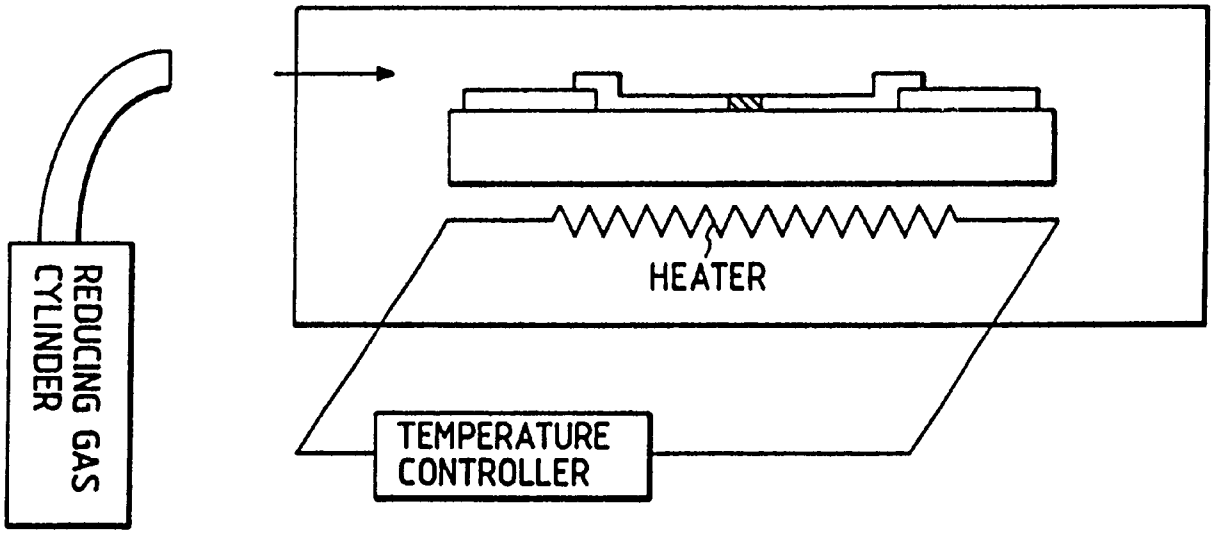
FIG. 19 is a schematic illustration of the chemical reduction step of a method of manufacturing an electron-emitting device according to the invention, using a reducing gas.

Step e:

As in the case of Example 1, an electron-emitting device comprising a pair of electrodes 5 and 6 and an electro-conductive film 4 including an electron-emitting region 3 arranged on a substrate 1 (FIG. 3C) and a monitoring device that had not been subjected to an electric forming operation (or that had undergone Steps a through c) were place in a vacuum apparatus as shown in FIG. 4, into which nitrogen gas containing hydrogen by 2% was introduced from a reducing gas cylinder as shown in FIG. 19 until it showed a partial pressure of 1 millitorr at room temperature in the apparatus, when the devices were heated to temperature between 130° C. and 200° C. and kept to that temperature for approximately an hour.

After the chemical reduction process for an hour, it was found that the electro-conductive film containing PdOx as a principal ingredient of the monitoring device without an electric forming process had been chemically reduced to become a film of fine particles of Pd metal having an electric resistance per unit area of $5\times10^2$ Ω/□ or a value smaller than the resistance before the chemical reduction by two digits.

In an attempt to see the properties of the electron-emitting device prepared through the preceding steps, it was observed for electron-emitting performance, using a gauging system as illustrated in FIG. 4. In the above observation, the distance H between the anode 34 and the electron-emitting device was 4 mm and the potential of the anode 34 was 1 kV, while the degree of vacuum in the vacuum chamber of the system was held to $1\times10^{-6}$ torr throughout the gauging operation.

A device voltage was applied between the device electrodes 5, 6 of the device to see the device current If and the emission current Ie under that condition. FIG. 6 shows the current-voltage relationships obtained as a result of the observation.

An emission current Ie began to flow through the device immediately when the device voltage (Vf) became as high as 14 V and a device current Ie of 2.2 milliA and an emission current Ie of 1.1 microA were observed when the device voltage rose to 14 V to provide an electron emission efficiency $\theta$=Ie/If×100(%) of 0.05%.

When the device was observed before the chemical reduction process, the film of PdO fine particles (electro-conductive film) of the device showed an electric resistance of 3.5 kΩ and the fissured area had an electric resistance of 6.4 kΩ. After the chemical reduction process, it was found that the electric resistance of the film of PdO fine particles of the electron-emitting device that had undergone a chemical reduction process (the device of this example) as low as 35 Ω, which was negligible when compared with that of the fissured area.

In other words, for an electron-emitting device after a chemical reduction process according to the invention to obtain the same electron emission rate as a device before the process having required a device voltage of 22 V, the device after the process required a power consumption rate of only 31 milliW, whereas it was only 48 milliW for the device before the process, i.e., the former being two thirds of the latter, thus proving a significant saving of power.

Note that the duration of chemical reduction process was as short as an hour and this fact can greatly contribute to raising the rate of manufacturing electron-emitting devices of the type under consideration. Additionally, since the chemical reduction process is conducted in an electric furnace under the atmospheric pressure, the entire facility required for manufacturing electron-emitting devices can be remarkably simplified.

Example 4

A total of twenty-five electron-emitting devices each having a configuration as shown in FIGS. 7A and 7B were prepared.

The process of preparing the electron-emitting devices will be described below in terms of a single device by referring to FIGS. 3A to 3C and FIGS. 7A and 7B.

Step a:

A silicon oxide film was formed on a thoroughly cleansed soda lime glass plate to a thickness of 0.5 microns by sputtering to produce a substrate 1, on which a pattern of photoresist (RD-2000N-41: available from Hitachi Chemical Co., Ltd.) was formed for a pair of device electrodes and a gap separating the electrodes and then Ti and Ni were sequentially deposited thereon respectively to thicknesses of 5 nm and 100 nm by vacuum deposition.

The photoresist pattern was dissolved in an organic solvent and the Ni/Ti deposit film was treated by using a lift-off technique to produce a pair of device electrodes 5 and 6 having a width W of 300 microns and separated from each other by a distance L of 20 microns (FIG. 3A).

Step b:

A Cr film was deposited by vacuum deposition on the entire surface of the substrate prepared in Step a and including the device electrodes 5 and 6 to a film thickness of 50 nm and then subjected to a patterning operation, using a mask (not shown) having opening with a length not smaller than L and a width W' for the gap separating the device electrodes and its vicinity. The film was then developed and etched for the opening to expose the gap L separating the electrodes and part of the device electrodes 5, 6, to produce a Cr mask having a width W' of 100 μm. Thereafter, organic Pd (ccp4230: available from Okuno Pharmaceutical Co., Ltd.) was applied to the Cr film by means of a spinner, while rotating the film, and baked at 300° C. for 10 minutes. Thereafter, the Cr film was etched by an acidic etchant and treated by using a lift-off technique to produce an electro-conductive film 4 (FIG. 3B).

The produced electro-conductive film 4 was made of fine particles containing PdO as a principal ingredient and had a film thickness of 100 angstroms and an electric resistance per unit area of $2\times10^4$ Ω/□.

Note that the term "a fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is that of recognizable fine particles arranged in any of the above described states.

Now, a pair of device electrodes 5, 6 and an electronconductive film 4 were formed on the substrate 1 for all the devices through the above steps.

Step c:

Then, the devices were set in position in a measuring system as illustrated in FIG. 4 and the inside of the vacuum chamber of the system was evacuated by means of an exhaust pump to a degree of vacuum of $2\times10^{-5}$ torr. Subsequently, a voltage Vf was applied from the power source 31 to the device electrodes 5, 6 of twenty four devices out of the twenty five devices to electrically energize the devices (electric forming process).

FIG. 5B shows the voltage waveform used for the electric forming process.

In FIG. 5B, T1 and T2 respectively denote the pulse width and the pulse interval of the applied pulse voltage, which were respectively 1 millisecond and 10 milliseconds for this example. The wave height (the peak voltage for the forming operation) of the applied pulse voltage was increased stepwise with steps of 0.1 V. During the electric forming operation, an additional pulse voltage of 0.1 V was inserted in each interval of T2 for measuring the resistance and the application of pulse voltage was terminated to complete the electric forming process when the resistance measured by using a pulsed voltage exceeded about 1 MΩ.

In the period from the beginning to the end of an electric forming process, the device current If gets to a maximum level of Imax, the voltage (or the wave height of the pulse voltage) corresponding to Imax being denoted by forming voltage Vform.

The forming voltage Vform for the above devices was approximately 7.0 V.

Step d:

Subsequently, a protective film forming operation was conducted on twelve out of the twenty four devices that had been subjected to the electric forming process. In this operation, a pulse voltage as shown in FIG. 5A and having a wave height value of 14 V was applied to the device electrodes 5, 6 of the devices in order to cause them emit electrons. The emitted electrons operated to decompose carbon compounds into carbon atoms, which were deposited on and near the electron-emitting regions 3 of the devices to produce a protective film.

The twelve devices subjected to the protective film forming operation are called devices A, whereas the remaining twelve devices not subjected to the protective film forming operation after the electric forming process are called devices B.

For the protective film forming operation, a pulse voltage was applied to the device electrodes 5, 6 of each device while observing the emission current Ie in the apparatus of FIG. 4, the inside of which apparatus was maintained to a degree of vacuum of $1.5\times10^{-5}$ torr.

The emission current Ie became saturated in approximately 30 minutes, when the protective film forming operation was terminated.

Step e:

All the devices including the ones that had not undergone an electric forming process were then subjected to a chemical reduction process.

In this operation, nitrogen gas containing hydrogen by 2% was introduced through a reducing gas inlet pipe (not shown) under the control of a mass flow controller (not shown) until it showed a partial pressure of 1 millitorr in the vacuum apparatus.

As the twenty five devices were exposed to this atmosphere for an hour, the electro-conductive films 4 of the devices containing PdO as a principal ingredient were chemically reduced to become so many films of fine Pd particles that showed an electric resistance per unit area of $5\times10^{2}$ Ω/□ or a value smaller than the resistance before the chemical reduction by two digits.

The change in the electric resistance of the films was confirmed by measuring the electric resistance between the device electrodes (hereinafter referred to as device resistance) of the single electron-emitting device that had not been subjected to an electric forming operation before and after the chemical reduction process. More specifically, the device resistance of the device was 4 kΩ before the chemical reduction and approximately 100 Ω after the chemical reduction.

In numerical terms, when an electron-emitting device prepared in a manner as described above is driven under the above described condition, a device current of approximately 1 mA flows through the device.

If the electro-conductive film 4 of the device is not chemically reduced, the device voltage shows a drop of approximately 4 V at the electro-conductive film 4 due to the relatively high electric resistance of the lateral portions of the film arranged at the opposite ends of the electron emitting region 3 to ineffectively consume power at a rate of 4 mW.

As seen from the graph of current-voltage relationship of a surface conduction electron-emitting device illustrated in FIG. 6, the emission current sharply or exponentially rises relative to the device voltage when the latter gets to Vth. Therefore, an electro-conductive film 4 that has not been treated for chemical reduction not only consumes power ineffectively but also lowers the voltage applied to the electron emitting region 3 and hence the rate of electron emission as the voltage drops at the lateral portions of the film.

So, in order for the emission current of an electron-emitting device that has not been treated for chemical reduction to become equal to that of an electron-emitting device that has undergone a chemical reduction process, the drive voltage of the former device has to be made approximately 4 V higher than that of the latter device.

In other words, a chemical reduction process is highly effective for efficiently driving a surface conduction electron-emitting device with a low voltage and a low energy consumption rate.

In order to further look into the profile and the performance of the surface conduction electron-emitting devices prepared through the above steps, one of the devices A and one of the devices B were picked up and observed through an electron microscope and the remaining devices were tested on a one by one basis in the apparatus of FIG. 4. The electron-emitting device to be tested was separated from the anode 34 by 4 mm and a voltage of 1 kV was applied to the anode 34 while maintaining the inside of the vacuum apparatus to a degree of vacuum of $1\times10^{-6}$ torr during the test.

A device voltage of 14 V was applied to each of the tested devices A and B to see the device current If and the emission current Ie.

When the twelve devices A is compared with the twelve devices B, the average device current If of the devices A was 1.0 mA and that of the devices B was 1.2 mA for the device voltage of 14 V whereas the emission current Ie of the former was 0.5 microA and that of the latter was 0.45 microA to provide an electron emission efficiency $\theta = Ie/If \times 100(\%)$ of 0.05% or the devices A and 0.04% for the devices B. The standard deviation of the dispersed emission current values relative to the average was approximately 6% for the devices A and approximately 10% for the devices B.

From the above observations, it was proved that the devices A had an ineffective current (part of the device current that does not contribute to electron emission) lower than that of the devices B and the former were also superior to that latter in terms of electron emission efficiency and uniformity.

Figure 20:
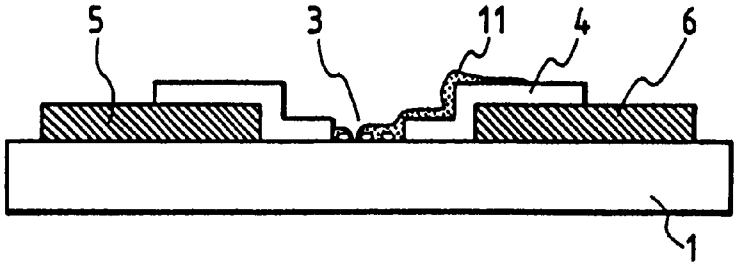
FIG. 20 is a schematic sectional view of an electron-emitting device according to the intention after it is covered by a protective film.

As a result of electron microscope observation, it was found that the sampled device A had a protective film 11 at the interface of the electro-conductive film 4 and the substrate 1 near the electron emitting region 3 on both the positive and negative sides as illustrated in FIG. 20, although the protective film was particularly remarkable on the positive electrode side. While a similar film was observed on the sample device B, it was markedly poor and not found in certain necessary areas.

When observed through an FE-SEM having a large magnification, it was found that the electroconductive film 4 of fine particles of each of the devices B that had been treated for chemical reduction without a protective film had been partly deformed and displaced in the vicinity of the electron emitting region 3. As the electron emitting region 3 had been partly covered back by the electroconductive film 4, the device electrodes 5 and 6 were slightly short-circuited through narrow routes of electric current. This might prove that the electron emitting region 3 had been partly destroyed as a result of chemical reduction. Contrary to this, such phenomena were not observed on the devices A that had been subjected to chemical reduction with a protective film.

It seemed that the protective film 11 had also been formed in periphery areas of and gaps separating metal fine particles of the electroconductive film 4. By observing the protective film through a TEM and a Raman spectroscope, it was found that the protective film 11 was composed of carbon mainly in the form of graphite and amorphous carbon or carbon compounds.

From the above observations, it can safely be concluded that the electron emitting region 3 and the remaining areas of the electroconductive film of fine particles of each of the device B were partly destroyed and displaced during the chemical reduction process as the surface energy was activated on the electroconductive film near and around the electron emitting region 3, leading to differentiated performances among the devices B. On the other hand, the protective film 11 of carbon or carbon compounds formed near and around the electron emitting region 3 of each of the devices A effectively prevented the electron emitting region 3 from being destroyed during the chemical reduction process so that the reduction process proceeded stably to produce uniform devices A.

Example 5

This example relates to an image-forming apparatus comprising a plurality of electron-emitting devices of the type A produced by the method of Example 2, where the electroconductive films 4 are made of $SnO_2$ and the electron-emitting devices are arranged to form a simple matrix.

FIG. 15 shows a schematic partial plan view of the electron source and FIG. 16 shows a schematic partial sectional view taken along line A–A' of FIG. 15, while FIGS. 17A–17F and 18G–18I illustrate schematic partial sectional views of the electron source shown in different manufacturing steps. Note that same or similar components are respectively designated by same reference symbols throughout FIGS. 15 through 18I.

91 denotes a substrate and 92 and 93 respectively denote X- and Y-directional wirings (which may be called lower and upper wirings respectively) that correspond to Dxm and Dyn in FIG. 9. Otherwise, the electron source comprises electron-emitting devices, each having an electroconductive film 4 and a pair of device electrodes 5 and 6, an interlayer insulation layer 161 and a number of contact holes, each of which is used to connect a device electrode 5 with a related lower wiring 92.

Now, the steps of manufacturing an electron source and an image-forming apparatus incorporating such as electron source used in this example will be described in detail.

Step a:

After thoroughly cleansing a soda lime glass plate a silicon oxide film was formed thereon to a thickness of 0.5 micrometers by sputtering to produce a substrate 91, on which Cr and Au were sequentially laid to thicknesses of 5.0 nm and 600 nm respectively and then a photoresist (AZ1370: available from Hoechst Corporation) was formed thereon by means of a spinner, while rotating the film, and baked. Thereafter, a photo-mask image was exposed to light and developed to produce a resist pattern for the lower wirings 92 and then the deposited Au/Cr film was wet-etched to produce lower wiring 82 having a desired profile (FIG. 17A).

Step b:

A silicon oxide film was formed as an interlayer insulation layer 161 to a thickness of 1.0 micrometer by RF sputtering (FIG. 17B).

Step c:

A photoresist pattern was prepared for producing contact holes 162 in the silicon oxide film deposited in Step b, which contact holes 162 were then actually formed by etching the interlayer insulation layer 161, using the photoresist pattern for a mask (FIG. 17C). RIE (Reactive Ion Etching) using $CF_4$ and $H_2$ gas was employed for the etching operation.

Step d:

Thereafter, a pattern of photoresist (RD-2000N-41: available from Hitachi Chemical Co., Ltd.) was formed for pairs of device electrodes 5 and 6 and gaps L1 separating the respective pairs of electrodes and then Ti and Ni were sequentially deposited thereon respectively to thicknesses of 5.0 nm and 100 nm by vacuum deposition. The photoresist pattern was dissolved by an organic solvent and the Ni/Ti deposit film was treated by using a lift-off technique to produce pairs of device electrodes 5 and 6, each pair having a width of 300 micrometers and separated from each other by a distance L1 of 20 micrometers (FIG. 17D).

Step e:

After forming a photoresist pattern on the device electrodes 5, 6 for upper wirings 93, Ti and Au were sequentially deposited by vacuum deposition to respective thicknesses of 5.0 nm and 500 nm and then unnecessary areas were removed by means of a lift-off technique to produce upper wirings 93 having a desired profile (FIG. 17E).

Step f:

Electroconductive films 2 made of a mixture of Sn and $SnO_2$ were produced by sputtering Sn in an oxygen atmosphere, using a metal mask that had an opening for the gap L1 separating the device electrodes and its vicinity of each device (FIG. 17F). The width of the electroconductive film 2 was 100 micrometers for this example. The formed electroconductive films 2 were made of fine particles containing $SnO_2$ as a principal ingredient and had a film thickness of 70 angstroms and an electric resistance per unit area of $2.5\times10^4$ Ω/□. Note that the term "a fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is that of recognizable fine particles arranged in any of the above described states.

Step g:

The Cr film 171 and the baked electroconductive film 2 were etched by using an acidic etchant to produce a desired pattern (FIG. 18G).

Step h:

Then, a pattern for applying photoresist to the entire surface area except the contact holes 162 was prepared and Ti and Au were sequentially deposited by vacuum deposition to respective thicknesses of 5.0 nm and 500 nm. Any unnecessary areas were removed by means of a lift-off technique to consequently bury the contact holes 162 (FIG. 18H).

Now, lower wirings 92, an interlayer insulation layer 161, upper wirings 93, and devices comprising pairs of device electrodes 5 and 6 and electroconductive films 2 were produced on the substrate 91.

Then, an electron source comprising the above electron source substrate and an image-forming apparatus incorporating such an electron source were prepared. This will be described below by referring to FIGS. 10, 11A and 11B.

The substrate 91 carrying thereon a large number of devices prepared in a manner as described above was rigidly fitted to a rear plate 101 and thereafter a face plate 106 (prepared by forming a fluorescent film 104 and a metal back 105 on a glass substrate 103) was arranged 5 mm above the substrate 91 by interposing a support frame 102 therebetween. Frit glass was applied to junction areas of the face plate 106, the support frame 102 and the rear plate 101, which were then baked at 400° C. for 10 minutes or more in the atmosphere and bonded together to a hermetically sealed condition (FIG. 10).

The substrate 91 was also firmly bonded to the rear plate 101 by means of frit glass.

In FIG. 10, reference numerals 92 and 93 respectively denote X- and Y-directional wirings.

While the fluorescent film 104 may be solely made of fluorescent bodies if the image-forming apparatus is for black and white pictures, firstly black stripes were arranged and then the gaps separating the black stripes were filled with respective fluorescent bodies for primary colors to produce a fluorescent film 104 for this example (FIG. 11A).

The black stripes were made of a popular material containing graphite as a principal ingredient.

The fluorescent bodies were applied to the glass substrate 103 by using a slurry method. A metal back 105 is normally arranged on the inner surface of the fluorescent film 104. In this example, a metal back was prepared by producing an A1 film by vacuum deposition on the inner surface of the fluorescent film 104 that had been smoothed in a so-called electric filming process.

The face plate 106 may be additionally provided with transparent electrodes (not shown) arranged close to the outer surface of the fluorescent film 104 in order to improve the conductivity of the fluorescent film 104, no such electrodes were used in this example because the metal back proved to be sufficiently conductive.

The fluorescent bodies were carefully aligned with the respective devices before the above described bonding operation.

The prepared glass container was then evacuated by means of an exhaust pipe (not shown) and an exhaust pump to achieve a sufficient degree of vacuum inside the container. Thereafter, the electroconductive film 2 of each of the devices arranged on the substrate 91 was subjected to an electric forming operation, where a voltage was applied to the device electrodes 5, 6 of the devices by way of the external terminals Dox1 through Doxm and Doy1 through Doyn to produce an electron-emitting region 3 in each electroconductive film 2.

The voltage used in the forming operation had a waveform same as the one shown in FIG. 5B.

Referring to FIG. 5B, T1 and T2 were respectively 1 milliseconds and 10 milliseconds and the electric forming operation was carried out in vacuum of a degree of approximately $1\times10^{-6}$ torr. The wave height (the peak voltage for the forming operation) of the applied pulse voltage was increased stepwise with steps of 0.1 V. During the electric forming operation, an additional pulse voltage of 0.1 V was inserted in each interval of T2 for measuring the resistance and the application of pulse voltages was terminated to complete the electric forming process when the resistance measured by using a pulsed voltage exceeded about 1 MΩ.

The forming voltage Vform for the above devices was approximately 4.0 V.

Fine particles containing $SnO_x$ as a principal ingredient and having an average diameter of 4.0 nm were observed to be dispersed throughout the electron emitting regions 3 of the electron-emitting devices procuded in a manner as described above.

Subsequently, a protective film forming operation was conducted on each of the devices under a vacuum condition same as that of the electric forming process, where a pulse voltage as shown in FIG. 5A was applied to the device electrodes 5 and 6 of the electron-emitting devices 94 through the external electrodes Dox1 through Doxm and Doy1 through Doyn.

In this operation, a pulse voltage having a wave height value of 14 V was applied to the device electrodes 5, 6 of the devices in order to cause them emit electrons, while observing the emission current Ie. The emission current Ie became saturated in approximately 30 minutes, when the protective film forming operation was terminated.

All the devices were then subjected to a chemical reduction process.

In this operation, nitrogen gas containing hydrogen by 2% was introduced through a reducing gas inlet pipe (not shown) under the control of a mass flow controller (not shown) until it showed a partial pressure of 1 millitorr in the vacuum apparatus.

As the devices were exposed to this atmosphere for an hour, the electroconductive films 4 of the devices containing $SnO_2$ as a principal ingredient were chemically reduced to become so many films of fine Sn particles that showed an electric resistance per unit area of $6\times10^2$ Ω/□ or a value smaller than the resistance before the chemical reduction by two digits.

Thus, the operation of preparing electron-emitting devices 94 were completed as they had been subjected to an electric forming operation, a protective film forming operation and a chemical reduction process to produce electron emitting regions 3.

Thereafter, the enclosure was evacuated to a degree of vacuum of approximately $10^{-6}$ torr and then hermetically sealed by melting and closing the exhaust pipe (not shown) by means of a gas burner.

The apparatus was subjected to a getter process using a high frequency heating technique in order to maintain the degree of vacuum in the apparatus after the sealing operation, where an getter disposed at a predetermined position (not shown) in the enclosure was heated by high frequency heating immediately before the sealing operation to form a film as a result of vapor deposition. The getter is a material containing Ba as a principal component.

The electron-emitting devices of the above image-forming apparatus were then caused to emit electrons by applying scanning signals and modulation signals generated by a signal generating means (not shown) thereto through the external terminals Dox1 through Doxm and Doy1 through Doyn and the emitted electrons were accelerated by applying a high voltage of greater than several kV to the metal back 105 or a transparent electrode (not shown) via the high voltage terminal Hv so that they collides with the fluorescent film 104 until the latter was energized to emit light and produce images.

The electron source prepared for this example consumed little power with a reduced drive voltage so that the load applied to the circuits that are peripheral to the electron source was also reduced. Consequently the image-forming apparatus incorporating such an electron source was prepared at low cost.

The image-forming apparatus operated stably with a reduced power consumption rate to display excellent images.

Example 6

This example deals with an image-forming apparatus comprising a large number of surface conduction electron-emitting devices and control electrodes (grids).

Since an apparatus to be dealt in this example can be prepared in a way as described above concerning the image-forming apparatus of Example 5, the method of manufacturing the same will not be described any further.

Each of the surface conduction electron-emitting devices of the device electrode had a gap of 50 micrometers between the device electrodes. A chemical reduction process was conducted on the devices in a manner similar to the one described earlier for Example 5. In this reduction process, the devices were exposed to nitrogen gas containing hydrogen by 2% and having a partial pressure of 100 mtorr for 30 minutes.

The configuration of the apparatus will be described in terms of the electron source of the apparatus prepared by arranging a number of surface conduction electron-emitting devices.

FIG. 13B shows a schematic plan view the electron source which is a ladder type. Referring to FIG. 13B, 144 denotes an electron source substrate typically made of soda lime glass and 131 denotes an surface conduction electron-emitting device arranged on the substrate 144 and shown in a dotted circle. Whereas Dx'1 through Dx'6 that are commonly indicated by 132 denote common wirings for the surface conduction electron-emitting devices.

The surface conduction electron-emitting devices 131 were arranged in rows running along X-direction (hereinafter referred to as device rows) and the surface conduction electron-emitting devices of each row are connected in parallel by a pair of common wirings running along the rows. Note that a single common wiring is arranged between any two adjacent device rows to serve for the both rows as a wiring electrode. For instance, common wiring or wiring electrode Dx'2 serves for both the first device row and the second device row.

This arrangement of wiring electrodes is advantageous in that, if compared with the arrangement of FIG. 13A, the space separating any two adjacent rows of surface conduction electron-emitting devices can be significantly reduced in Y-direction.

In the apparatus of this example comprising the above described electron source, the electron source can drive any device rows independently by applying an appropriate drive voltage to the related wiring electrodes. More specifically, a voltage exceeding the threshold voltage level for electron emission is applied to the device rows to be driven to emit electrons, whereas a voltage not exceeding the threshold voltage level for electron emission (e.g., 0 V) is applied to the remaining device rows. (A voltage exceeding the threshold voltage level and used for the purpose of the invention is expressed by drive voltage Vope[V] hereinafter.)

For instance, only the devices of the third row can be driven to operate by applying 0[V] to the wiring electrodes Dx'1 through Dx'3 and Vope[V] to the wiring electrodes Dx'4 through Dx'6. Consequently, Vope-0=Vope[V] is applied to the devices of the third row, whereas 0[V], 0–0=0[V] or Vope-Vope=0[V], is applied to all the devices of the remaining rows.

Likewise, the devices of the second and the fifth rows can be driven to operate simultaneously by applying 0[V] to the wiring electrodes Dx'1, Dx'2 and Dx'6 and Vope[V] to the wiring electrodes Dx'3, Dx'4 and Dx'5. In this way, the devices of any device row of this electron source can be driven selectively.

While each device row has twelve (12) surface conduction electron-emitting devices arranged along the X-direction in the electron sources of FIG. 13B, the number of devices to be arranged in a device row is not limited thereto and a greater number of devices may alternatively be arranged. Additionally, while there are five (5) device rows in the electron source, the number of device rows is not limited thereto and a greater number of device rows may alternatively be arranged.

Now, a panel type CRT incorporating an electron source of the above described type will be described.

FIG. 14 is a schematic perspective view of a panel type CRT incorporating an electron source as illustrated in FIG. 13B. In FIG. 14, VC denote a glass vacuum container provided with a face plate for displaying images as a component thereof. A transparent electrode made of ITO is arranged on the inner surface of the face plate and red, green and blue fluorescent members are applied onto the transparent electrode in the form of a mosaic or stripes without interfering with each other. To simplify the illustration, the transparent electrodes and the fluorescent members are collectively indicated by reference symbol 104 in FIG. 14. Black stripes known in the field of CRT may be arranged to fill the blank areas of the transparent electrode that are not occupied by the fluorescent stripes. Similarly, a metal back layer of any known type may be arranged on the fluorescent members. The transparent electrode is electrically connected to the outside of the vacuum container by way of a terminal Hv so that an voltage may be applied thereto in order to accelerate electron beams.

In FIG. 14, 144 denotes the substrate of the electron source rigidly fitted to the bottom of the vacuum container VC, on which a number of surface conduction electron-emitting devices are arranged in a manner as described above by referring to FIG. 13B. The wiring electrodes of the device rows are electrically connected to respective electrode terminals Dox1 through Dox(m+1) arranged on a lateral panel of the apparatus so that electric drive signals may be applied thereto from outside of the vacuum enclosure (m=200 for the apparatus of this example).

Stripe-shaped grid electrodes 140 are arranged in the middle between the substrate 144 and the face plate 106. There are provided a total of 200 grid electrodes GR-arranged in a direction perpendicular to that of the device rows (or in the Y-direction) and each grid electrode has a given number of openings 141 for allowing electron beams to pass therethrough. More specifically, a circular opening 141 is provided for each surface conduction electron-emitting device. The grid electrodes are electrically connected to the outside of the vacuum container via respective electric terminals G1 through Gn (n=200 for the apparatus of this example).

The above described display panel comprises surface conduction electron-emitting devices arranged in 200 device rows and 200 grid electrodes to form an X-Y matrix of 200×200. With such an arrangement, an image can be displayed on the screen on a line by line basis by applying a modulation signal to the grid electrodes for a single line of an image in synchronism with the operation of driving (scanning) the surface conduction electron-emitting devices on a row by row basis to control the irradiation of electron beams onto the fluorescent film.

Figure 22:
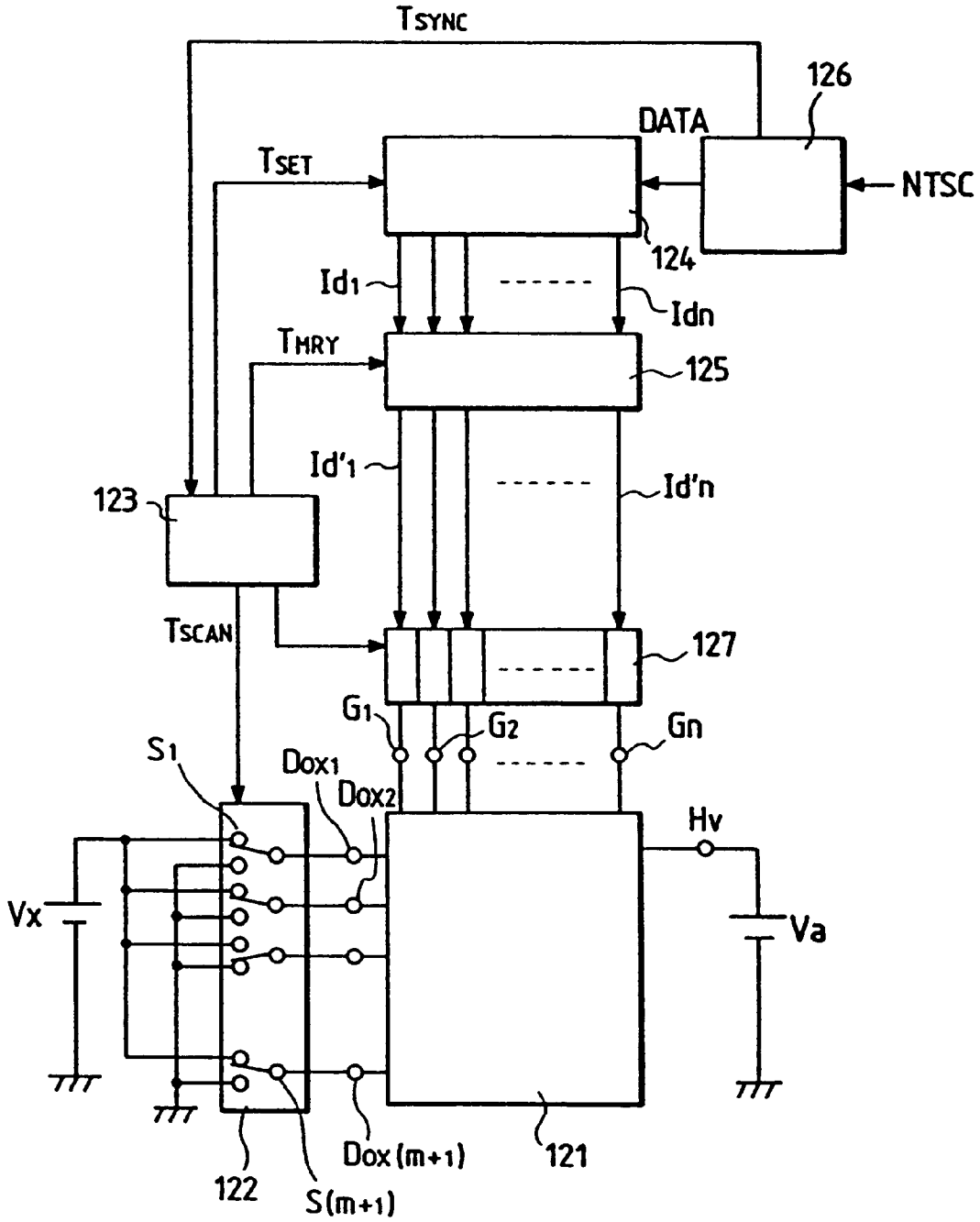
FIG. 22 is a block diagram of the drive circuit of an image-forming apparatus according to the invention adapted for the NTSC system obtained by modifying that of FIG. 12.

FIG. 22 is a block diagram of an electric circuit to be used for driving the display panel of the above described electron source having a ladder-like arrangement in order to display images according to TV signals of the NTSC system. Pulse modulation was used for the image-forming apparatus.

The electron-emitting devices of the above image-forming apparatus were then caused to emit electrons by applying scanning signals and modulation signals generated by a signal generating means thereto through the external terminals Dox1 through Dox(m+1) and Doy1 through Doyn and the emitted electrons were accelerated by applying a high voltage of 10 kV to a metal back (not shown) or a transparent electrode (not shown) via the high voltage terminal Hv so that they collides with the fluorescent film 104 until the latter was energized to emit light and produce images.

The electron source prepared for this example consumed little power with a reduced drive voltage so that the load applied to the circuits that are peripheral to the electron source was also reduced. Consequently the image-forming apparatus incorporating such an electron source was prepared at low cost.

Example 7

Contrary to Example 1 where the film of fine PdO particles of an electron-emitting device was chemically reduced by heating in vacuum, the film of fine particles of the electron-emitting device of this example was heated and reduced in a reducing solution.

The electron-emitting device having a configuration as illustrated in FIGS. 7A and 7B was prepared by following Steps a through e, of which Steps a through d are same as those of Example 1 above. So, only Step e will be described here.

As in the case of Example 1, the device comprising a pair of device electrodes 5, 6 and an electroconductive film 4 including an electron emitting region 3 arranged on a substrate 1 was subjected to a chemical reduction process as described below.

Figure 21:
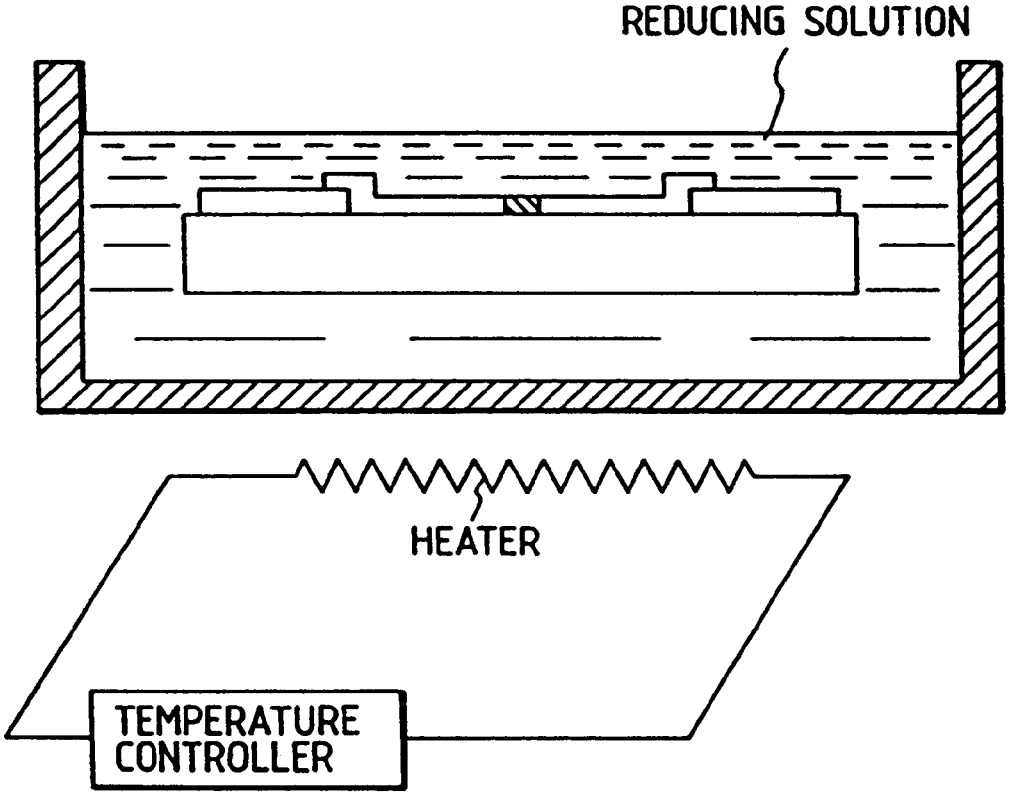
FIG. 21 is a schematic illustration of the chemical reduction step of a method of manufacturing an electron-emitting device according to the invention and conducted in a reducing solution.

Step e:

As shown in FIG. 21, the electron-emitting device was placed in a liquid of 100% formic acid (reducing liquid) and heated to temperature between 50° C. and 60° C. for two minutes by means of a heater which is connected to a temperature controller. Consequently, the PdO in the form of a film of fine particles of the device that has not undergone an electric forming process was chemically reduced to become metal Pd also in the form a film of fine particles having an electric resistance per unit area of $5\times10^2$ Ω/□ or a value smaller than the resistance before the chemical reduction by two digits.

In an attempt to see the properties of the flat type electron-emitting device prepared through the preceding steps, it was observed for electron-emitting performance, using a measuring system as illustrated in FIG. 4. In the above observation, the distance H between the anode 34 and the electron-emitting device was 4 mm and the potential of the anode 34 was 1 kV, while the degree of vacuum in the vacuum chamber of the system was held to $1\times10^{-6}$ torr throughout the gauging operation.

A device voltage was applied between the device electrodes 5, 6 of the device to see the device current If and the emission current Ie under that condition. FIG. 6 shows the current-voltage relationships obtained as a result of the observation.

The emission current Ie of the device began to increase sharply when the device voltage (Vf) became as high as 8 and a device current If of 2.0 milliA and an emission current Ie of 1.2 microA were observed when the device voltage rose to 14 V to provide an electron emission efficiency θ=Ie/If×100(%) of 0.06%.

When the device was observed before the chemical reduction process, the film of PdO fine particles (electroconductive film) of the device showed an electric resistance of 3.5 kΩ and the fissured area had an electric resistance of 7 kΩ.

After the chemical reduction process, it was found that the electric resistance of the film of PdO fine particles of the electron-emitting device that had undergone an chemical reduction process (the device of this example) was as low as 30 Ω, which was negligible when compared with that of the fissured area.

In other words, for an electron-emitting device after a chemical reduction process according to the invention to obtain the same electron emission rate as a device before the process having required a device voltage of 21 V, the device after the process required a power consumption rate of only 28 milliW, whereas it was 42 milliW for the device before the process, i.e., the former being two thirds of the latter, thus proving a significant saving of power.

Note that the duration of chemical reduction process was as short as two hour or much shorter than that of the device of Example 1, which was ten hours and this fact can further contribute to raising the rate of manufacturing electron-emitting devices of the type under consideration. Additionally, since the chemical reduction process does not require any gas nor vacuum apparatus, the entire facility required for manufacturing electron-emitting devices can be remarkably simplified.

Example 8

Figure 23:
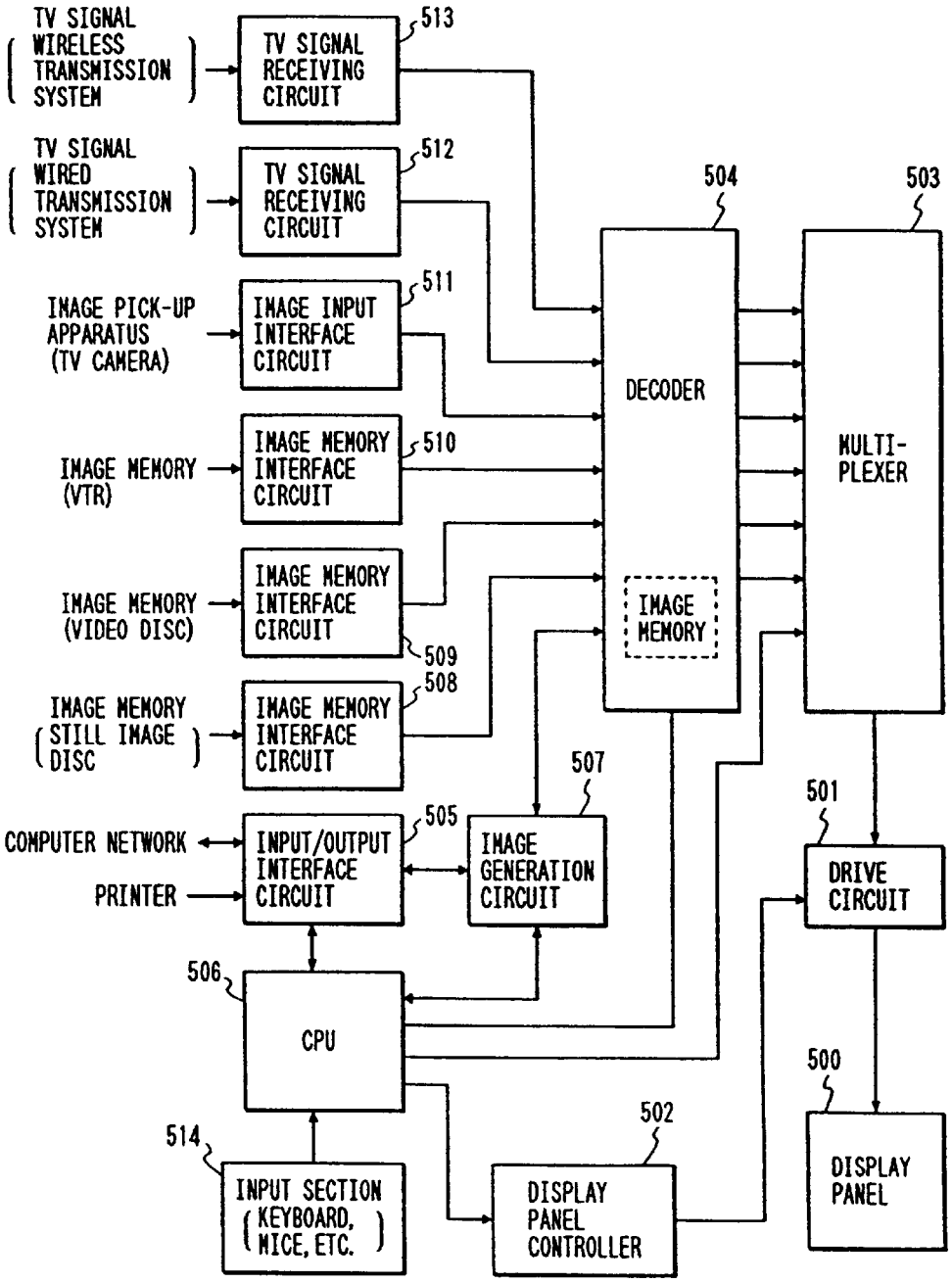
FIG. 23 is a block diagram of a display apparatus realized by using an image-forming apparatus according to the invention.
Figure 24:
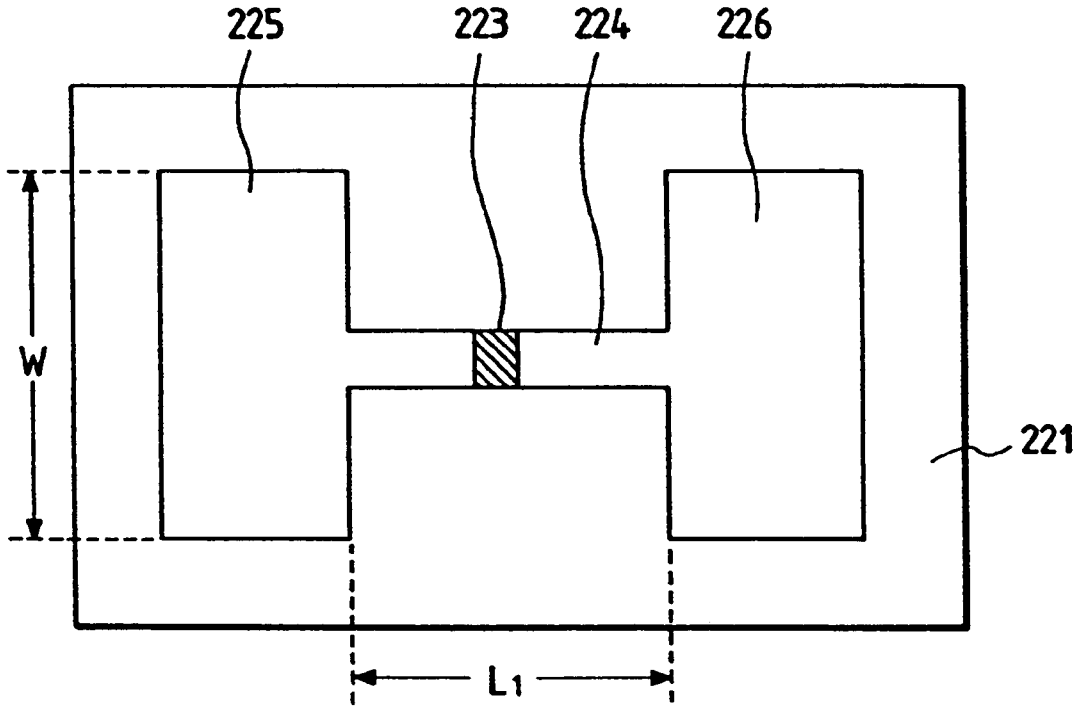
FIG. 24 is a schematic plan view of a conventional surface conduction electron-emitting device.

FIG. 23 is a block diagram of the display apparatus comprising an electron source realized by arranging a number of surface conduction electron-emitting devices and a display panel and designed to display a variety of visual data as well as pictures of television transmission in accordance with input signals coming from different signal sources.

Referring to FIG. 23, the apparatus comprises a display panel 500, a display panel drive circuit 501, a display panel controller 502, a multiplexer 503, a decoder 504, an input/output interface circuit 505, a CPU 506, an image generation circuit 507, image memory interface circuits 508, 509 and 510, an image input interface circuit 511, TV signal receiving circuits 512 and 513 and an input section 514. If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention.

Now, the components of the apparatus will be described, following the flow of image data therethrough.

Firstly, the TV signal reception circuit 513 is a circuit for receiving TV image signals transmitted via a wireless transmission system using electromagnetic waves and/or spatial optical telecommunication networks.

The TV signal system to be used is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels.

The TV signals received by the TV signal reception circuit 513 are forwarded to the decoder 504.

Secondly, the TV signal reception circuit 512 is a circuit for receiving TV image signals transmitted via a wired transmission system using coaxial cables and/or optical fibers. Like the TV signal reception circuit 513, the TV signal system to be used is not limited to a particular one and the TV signals received by the circuit are forwarded to the decoder 504.

The image input interface circuit 511 is a circuit for receiving image signals forwarded from an image input device such as a TV camera or an image pick-up scanner. It also forwards the received image signals to the decoder 504.

The image memory interface circuit 510 is a circuit for retrieving image signals stored in a video tape recorder (hereinafter referred to as VTR) and the retrieved image signals are also forwarded to the decoder 504.

The image memory interface circuit 509 is a circuit for retrieving image signals stored in a video disc and the retrieved image signals are also forwarded to the decoder 504.

The image memory interface circuit 508 is a circuit for retrieving image signals stored in a device or storing still image data such as so-called still disc and the retrieved image signals are also forwarded to the decoder 504.

The input/output interface circuit 505 is a circuit for connecting the display apparatus and an external output signal source such as a computer, a computer network or a printer. It carries out input/output operations for image data and data on characters and graphics and, if appropriate, for control signals and numerical data between the CPU 506 of the display apparatus and an external output signal source.

The image generation circuit 507 is a circuit for generating image data to be displayed on the display screen on the basis of the image data and the data on characters and graphics input from an external output signal source via the input/output interface circuit 505 or those coming from the CPU 506. The circuit comprises reloadable memories for storing image data and data on characters and graphics, read-only memories for storing image patterns corresponding given character codes, a processor for processing image data and other circuit components necessary for the generation of screen images.

Image data generated by the circuit for display are sent to the decoder 504 and, if appropriate, they may also be sent to an external circuit such as a computer network or a printer via the input/output interface circuit 505.

The CPU 506 controls the display apparatus and carries out the operation of generating, selecting and editing images to be displayed on the display screen. For example, the CPU 506 sends control signals to the multiplexer 503 and appropriately selects or combines signals for images to be displayed on the display screen.

At the same time it generates control signals for the display panel controller 502 and controls the operation of the display apparatus in terms of image display frequency, scanning method (e.g., interlaced scanning or non-interlaced scanning), the number of scanning lines per frame and so on.

The CPU 506 also sends out image data and data on characters and graphic directly to the image generation circuit 507 and accesses external computers and memories via the input/output interface circuit 505 to obtain external image data and data on characters and graphics.

The CPU 506 may additionally be so designed as to participate other operations of the display apparatus including the operation of generating and processing data like the CPU of a personal computer or a word processor. The CPU 506 may also be connected to an external computer network via the input/output interface circuit 505 to carry out numerical computations and other operations, cooperating therewith.

The input section 514 is used for forwarding the instructions, programs and data given to it by the operator to the CPU 506. As a matter of fact, it may be selected from a variety of input devices such as keyboards, mice, joy sticks, bar code readers and voice recognition devices as well as any combinations thereof.

The decoder 504 is a circuit for converting various image signals input via said circuits 507 through 513 back into signals for three primary colors, luminance signals and I and Q signals. Preferably, the decoder 504 comprises image memories as indicated by a dotted line in FIG. 23 for dealing with television signals such as those of the MUSE system that require image memories for signal conversion.

The provision of image memories additionally facilitates the display of still images as well as such operations as thinning out, interpolating, enlarging, reducing, synthesizing and editing frames to be optionally carried out by the decoder 504 in cooperation with the image generation circuit 507 and the CPU 506.

The multiplexer 503 is used to appropriately select images to be displayed on the display screen according to control signals given by the CPU 506. In other words, the multiplexer 503 selects certain converted image signals coming from the decoder 504 and sends them to the drive circuit 501. It can also divide the display screen in a plurality of frames to display different images simultaneously by switching from a set of image signals to a different set of image signals within the time period for displaying a single frame.

The display panel controller 502 is a circuit for controlling the operation of the drive circuit 501 according to control signals transmitted from the CPU 506. Among others, it operates to transmit signals to the drive circuit 501 for controlling the sequence of operations of the power source (not shown) for driving the display panel in order to define the basis operation of the display panel.

It also transmits signals to the drive circuit 501 for controlling the image display frequency and the scanning method (e.g., interlaced scanning or noninterlaced scanning) in order to define the mode of driving the display panel.

If appropriate, it also transmits signals to the drive circuit 501 for controlling the quality of the images to be displayed on the display screen in terms of luminance, contrast, color tone and sharpness.

The drive circuit 501 is a circuit for generating drive signals to be applied to the display panel 500. It operates according to image signals coming from said multiplexer 503 and control signals coming from the display panel controller 502.

A display apparatus according to the invention and having a configuration as described above and illustrated in FIG. 23 can display on the display panel 500 various images given from a variety of image data sources.

More specifically, image signals such as television image signals are converted back by the decoder 504 and then selected by the multiplexer 503 before sent to the drive circuit 501. On the other hand, the display controller 502 generates control signals for controlling the operation of the drive circuit 501 according to the image signals for the images to be displayed on the display panel 500.

The drive circuit 501 then applies drive signals to the display panel 500 according to the image signals and the control signals. Thus, images are displayed on the display panel 500.

All the above described operations are controlled by the CPU 506 in a coordinated manner.

The above described display apparatus can not only select and display particular images out of a number of images given to it but also carry out various image processing operations including those for enlarging, reducing, rotating, emphasizing edges of, thinning out, interpolating, changing colors of and modifying the aspect ratio of images and editing operations including those for synthesizing, erasing, connecting, replacing and inserting images as the image memories incorporated in the decoder 504, the image generation circuit 507 and the CPU 506 participate such operations.

Although not described with respect to the above embodiment, it is possible to provide it with additional circuits exclusively dedicated to audio signal processing and editing operations.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an OA apparatus such as a word processor, as a game machine and in many other ways.

It may be needless to say that FIG. 23 shows only an example of possible configuration of a display apparatus comprising a display panel provided with an electron source prepared by arranging a number of surface conduction electron-emitting devices and the present invention is not limited thereto. For example, some of the circuit components of FIG. 23 may be omitted or additional components may be arranged there depending on the application.

For instance, if a display apparatus according to the invention is used for visual telephone, it may be appropriately made to comprise additional components such as a television camera, a microphone, lighting equipment and transmission/reception circuits including a modem.

Since a display apparatus according to the invention comprises a display panel that is provided with an electron source prepared by arranging a large number of surface conduction electron-emitting device and hence adaptable to reduction in the depth, the overall apparatus can be made very thin.

Additionally, since a display panel comprising an electron source prepared by arranging a large number of surface conduction electron-emitting devices is adapted to have a large display screen with an enhanced luminance and provide a wide angle for viewing, it can offer really impressive scenes to the viewers with a sense of presence.

Advantages of the Invention

As described in detail above, the present invention make it possible to reduce the drive voltage and the power consumption rate of an electron-emitting device and hence provide an energy saving electron source and a high quality image-forming apparatus incorporating such an electron source.

Additionally, according to the invention, since it is now possible to provide a large gap between the device electrodes of an electron-emitting device without significantly consuming power, electron-emitting devices can be manufactured on a mass production basis without particularly paying attention to the precision of printing operations.

What is claimed is:

1. A method of manufacturing an electron source comprising a substrate, wires, and a plurality of electron-emitting elements disposed on said substrate, the electron-emitting elements being connected together by said wires, each electron-emitting element comprising a pair of electrodes and a conductive film having an electron-emitting section disposed between and connected to said pair of electrodes, said method comprising the steps of:

forming a plurality of conductive films, from which respective electron-emitting sections are formed, on said substrate by applying a solution containing a metal to a plurality of locations on said substrate and by heating the solution, so as to provide respective conductive films having respective electrical resistances; and reducing the electrical resistances of said respective conductive films by chemically reducing the whole of each respective conductive film, wherein said reducing step includes a process of heating said conductive films at a temperature in a range from 20° C. to 400° C., controlled by a temperature controller, and the process of heating is performed by heating said substrate on which said conductive films are formed.

2. A method of manufacturing an electron source according to claim 1, wherein the step of heating the conductive films in said reducing step is performed within an atmosphere containing a hydrogen gas.

3. A method of manufacturing an electron source according to claim 1, wherein the step of heating the conductive films in said reducing step is performed within an atmosphere containing a gaseous mixture of hydrogen and nitrogen.

4. A method of manufacturing an electron source comprising a substrate, a plurality of X-directional wires, a plurality of Y-directional wires, and a plurality of electron-emitting elements disposed on said substrate and connected together in a matrix configuration by said plurality of X-directional wires and said plurality of Y-directional wires, each electron-emitting element comprising a pair of electrodes and a conductive film having an electron-emitting section disposed between and connected to said pair of electrodes, said method comprising the steps of:

forming a plurality of conductive films, from which respective electron-emitting sections are formed, on said substrate by applying a solution containing a metal to a plurality of locations on said substrate and by heating the solution so as to form respective conductive films having respective electrical resistances; and reducing the electrical resistances of said respective conductive films by chemically reducing the whole of each conductive film, wherein said reducing step includes a process of heating said conductive films at a temperature in a range from 20° C. to 400° C., controlled by a temperature controller, and the process of heating is performed by heating said substrate on which said conductive films are formed.

5. A method of manufacturing an electron source according to claim 4, wherein the step of heating of the conductive films in said reducing step is performed within an atmosphere containing a hydrogen gas.

6. A method of manufacturing an electron source according to claim 4, wherein the step of heating the conductive films in said reducing step is performed within an atmosphere containing a gaseous mixture of hydrogen and nitrogen.

7. A method of manufacturing an electron source comprising a substrate, wires, and a plurality of electron-emitting elements disposed on said substrate and connected together by said wires, each electron-emitting element comprising a pair of electrodes and a conductive film having an electron-emitting section disposed between and connected to said pair of electrodes, said method comprising the steps of:

forming a plurality of conductive films, from which respective electron-emitting sections are formed, on said substrate, by applying a solution containing a metal to a plurality of locations on said substrate and heating the solution so as to form respective conductive films having respective electrical resistances;

energizing said respective conductive films; and reducing the electrical resistances of said respective conductive films by chemically reducing the whole of each conductive film, wherein said reducing step includes a process of heating said plurality of conductive films within an atmosphere at a temperature in a range from 20° C. to 400° C., controlled by a temperature controller, and the process of heating is performed by heating said substrate on which said conductive films are formed.

8. A method of manufacturing an electron source according to claim 7, wherein the step of heating said plurality of conductive films in said reducing step is performed within an atmosphere containing a hydrogen gas.

9. A method of manufacturing an electron source according to claim 7, wherein the step of heating said plurality of conductive films in said reducing step is performed within an atmosphere containing a gaseous mixture of hydrogen and nitrogen.

10. A method of manufacturing an electron source comprising a substrate, a plurality of X-directional wires, a plurality of Y-directional wires, and a plurality of electron-emitting elements disposed on said substrate and connected together in matrix configuration by said plurality of X-directional wires and said plurality of Y-directional wires, each electron-emitting element comprising a pair of electrodes and a conductive film having an electron-emitting section disposed between and connected to said pair of electrodes, said method comprising the steps of:

forming a plurality of conductive films, from which respective electron-emitting sections are formed, on said substrate by applying a solution containing a metal to a plurality of locations on said substrate and by heating the solution so as to form respective conductive films having respective electrical resistances;

energizing said respective conductive films; and reducing the electrical resistance of said respective conductive films by chemically reducing the whole of each conductive film, wherein said reducing step includes a process of heating said plurality of conductive films at a temperature in a range from 20° C. to 400° C., controlled by a temperature controller, and the process of heating is performed by heating said substrate on which said conductive films are formed.

11. A method of manufacturing an electron source according to claim 10, wherein the step of heating said plurality of conductive films in said reducing step is performed within an atmosphere containing a hydrogen gas.

12. A method of manufacturing an electron source according to claim 10, wherein the step of heating said plurality of conductive films in said reducing step is performed within an atmosphere containing a gaseous mixture of hydrogen and nitrogen.

13. A method of manufacturing an image forming apparatus comprising an electron source and an image forming member for forming an image when irradiated by electrons emitted from said electron source, wherein said electron source is produced by a method according to any one of claims 1, 2–6, and 7–12.

* * * * *

UNITED STATES PATENT AND TRADEMARK OFFICE

CERTIFICATE OF CORRECTION

PATENT NO. : 6,626,719 B2
DATED : September 30, 2003
INVENTOR(S) : Takeo Ono et al.

It is certified that error appears in the above-identified patent and that said Letters Patent is hereby corrected as shown below:

Column 1,
Line 20, "include" should read -- includes --.

Column 2,
Line 24, "application" should read -- applications --.

Column 3,
Line 23, "the," should read -- the --.

Column 4,
Line 55, "intention" should read -- invention --.

Column 5,
Line 41, "same,of" should read -- sake of --;
Line 51, "include" should read -- includes --; and
Line 52, "Ps=Rs●id" should read -- Ps=Rs●$id^2$ --.

Column 6,
Line 9, "Rf'=[L/(2●W)]●$R_0$==" should read -- Rf'=[L/(2●W)]●$R_0$□. --;
Line 18, "3pm" should read -- 3 $\mu$m --;
Line 19, "pm" should read -- $\mu$m --; and
Line 59, "reductions" should read -- reduction --.

Column 7,
Line 36, "charged" should read -- changed --.

Column 8,
Line 25, "KV" should read -- kV --;
Line 34, "have" should read -- has --; and
Line 48, "conditions," should read -- condition, --.

Column 9,
Line 1, "applying" should be deleted.

Column 10,
Line 16, "ing" should read -- en --.

Column 11,
Line 25, "$In_2$ O-$SnO_2$" should read -- $In_2O_3$-$SnO_2$ --;
Line 45, "factors and" should read -- factors, and is --;
Line 47, "hundreds" should read -- hundred --;
Line 50, "after" should read -- after being --;

UNITED STATES PATENT AND TRADEMARK OFFICE

CERTIFICATE OF CORRECTION

PATENT NO. : 6,626,719 B2
DATED : September 30, 2003
INVENTOR(S) : Takeo Ono et al.

It is certified that error appears in the above-identified patent and that said Letters Patent is hereby corrected as shown below:

Column 11 (cont'd),
Line 60, "thousands" should read -- thousand --; and
Line 61, "hundreds" should read -- hundred --.

Column 12,
Line 1, "hundreds of several" should read -- several hundred --;
Lines 24 and 25, "hundreds" should read -- hundred --; and
Line 55, "to" should read -- to as --.

Column 13,
Line 25, "a" should read -- as --.

Column 14,
Line 4, "are" should read -- as --; and
Line 57, "denotes" should read -- denote --.

Column 15,
Line 56, "principle" should read -- principal --.

Column 16,
Lines 8 and 14, "Doym" should read -- Doyn --; and
Line 19, "V," should read -- kV, --.

Column 17,
Line 12, "devices" should read -- device --; and
Line 30, "voltage,for" should read -- voltage for --.

Column 19,
Line 28, "devices" should read -- device --.

Column 20,
Line 53, "electro-conductive" should read -- electroconductive --.

Column 21,
Line 12, "electro-conductive" should read -- electroconductive -- and "PdOx" should read -- $PdO_x$ --; and
Line 16, "$5 \times 10^{-2}$" should read -- $5 \times 10^{2}$ --.

Column 23,
Lines 1, 13 and 25, "electro-conductive" should read -- electroconductive --; and
Line 58, "The" should read -- Although the --.

UNITED STATES PATENT AND TRADEMARK OFFICE

CERTIFICATE OF CORRECTION

PATENT NO. : 6,626,719 B2
DATED : September 30, 2003
INVENTOR(S) : Takeo Ono et al.

It is certified that error appears in the above-identified patent and that said Letters Patent is hereby corrected as shown below:

Column 24,
Lines 4 and 29, "electro-conductive" should read -- electroconductive --;
Line 12, "milliseconds" should read -- millisecond --;
Line 30, "each" should read -- of each --; and
Line 31, "device" should read -- devices --.

Column 25,
Line 7, "collides" should read -- collided --;
Line 28, "place" should read -- placed --; and
Line 37, "electro-conductive" should read -- electroconductive -- and "PdOx" should read -- $PdO_x$ --.

Column 27,
Lines 15 and 40, "twenty four" should read -- twenty-four --;
Line 16, "twenty five" should read -- twenty-five --; and
Line 44, "emit" should read -- to emit --.

Column 28,
Line 4, "twenty five" should read -- twenty-five --;
Lines 5, 26 and 35, "electro-conductive" should read -- electroconductive --; and
Line 65, "is" should read -- are --.

Column 29,
Line 4, "or" should read -- for --; and
Line 16, "electro-conductive" should read -- electroconductive --.

Column 30,
Line 15, "as" should read -- an --; and
Line 16, "used" should read -- as is used --.

Column 31,
Line 55, "Al" should read -- Al --.

Column 32,
Line 39, "them" should read -- them to --.

Column 33,
Line 14, "collides" should read -- collided --;
Line 31, "in" should read -- with in --;
Line 47, "the" should read -- of the --;

UNITED STATES PATENT AND TRADEMARK OFFICE

CERTIFICATE OF CORRECTION

PATENT NO. : 6,626,719 B2
DATED : September 30, 2003
INVENTOR(S) : Takeo Ono et al.

It is certified that error appears in the above-identified patent and that said Letters Patent is hereby corrected as shown below:

Column 33 (cont'd),
Line 50, "an" should read -- a --; and
Line 52, "circle. Whereas" should read -- circle, whereas --.

Column 34,
Line 40, "denote" should read -- denotes --.

Column 35,
Line 36, "collides" should read -- collided --.

Column 36,
Line 48, "hour" should read -- hours --.

Column 37,
Line 65, "given" should read -- to given --.

Column 38,
Line 22, "other" should read -- in other --.

Column 39,
Line 18, "sent" should read -- being sent --; and
Line 39, "such" should read -- in such --.

Column 40,
Line 4, "device" should read -- devices --; and
Line 15, "make" should read -- makes --.

Signed and Sealed this

Twenty-eighth Day of June, 2005

JON W. DUDAS
*Director of the United States Patent and Trademark Office*